US008434331B2

(12) United States Patent
Funaki et al.

(10) Patent No.: US 8,434,331 B2
(45) Date of Patent: May 7, 2013

(54) TUBULAR KNITTED FABRIC AND KNITTING METHOD THEREOF

(75) Inventors: Nobuo Funaki, Wakayama (JP); Takahiro Yamashita, Wakayama (JP); Isao Yumiba, Wakayama (JP); Takashi Kino, Wakayama (JP)

(73) Assignee: Shima Seiki Mfg., Ltd., Wakayama-shi, Wakayama (JP)

( * ) Notice: Subject to any disclaimer, the term of this patent is extended or adjusted under 35 U.S.C. 154(b) by 0 days.

(21) Appl. No.: 13/203,283

(22) PCT Filed: Feb. 20, 2010

(86) PCT No.: PCT/JP2010/001113

§ 371 (c)(1),
(2), (4) Date: Sep. 22, 2011

(87) PCT Pub. No.: WO2010/098052

PCT Pub. Date: Sep. 2, 2010

(65) Prior Publication Data

US 2012/0000252 A1 Jan. 5, 2012

(30) Foreign Application Priority Data

Feb. 25, 2009 (JP) ..... 2009-042612
Oct. 16, 2009 (JP) ..... 2009-239863

(51) Int. Cl.
*D04B 7/34* (2006.01)

(52) U.S. Cl.
USPC ..... 66/65; 66/174

(58) Field of Classification Search ..... 66/60 R, 66/64, 69, 70, 76, 169 R, 170–172 R, 175, 66/176, 65, 174
See application file for complete search history.

(56) References Cited

U.S. PATENT DOCUMENTS

| | | | | |
|---|---|---|---|---|
| 2,877,635 | A * | 3/1959 | Powell | 66/65 |
| 3,115,760 | A * | 12/1963 | Pierce | 66/65 |
| 6,119,487 | A * | 9/2000 | Okuno | 66/75.1 |
| 6,786,066 | B2 * | 9/2004 | Okamoto | 66/172 R |
| 7,212,881 | B2 * | 5/2007 | Kazuyoshi | 700/141 |
| 7,225,646 | B2 * | 6/2007 | Okamoto | 66/176 |
| 7,263,860 | B2 * | 9/2007 | Okuno | 66/64 |
| 7,437,895 | B2 * | 10/2008 | Okuno | 66/65 |
| 7,460,926 | B2 * | 12/2008 | Okamoto | 700/141 |

(Continued)

FOREIGN PATENT DOCUMENTS

| | | | |
|---|---|---|---|
| JP | 2006-109782 | A1 | 10/2006 |
| JP | 2008-115475 | A | 5/2008 |
| JP | 2008-121152 | A | 5/2008 |
| JP | 2010-037701 | A | 2/2010 |

*Primary Examiner* — Danny Worrell
(74) *Attorney, Agent, or Firm* — Rothwell, Figg, Ernst & Manbeck, P.C.

(57) ABSTRACT

Disclosed is a tubular knit glove and method of flatbed knitting. The outward portion of a thumb pouch (7) is knitted while the direction of the wales continues from the end of a four finger body (6) with a reciprocating motion in the direction of the course. Rows of stitches are knit in the center and yarn-overs (8,9) are added on each side as connecting stitches. The inward portion of a thumb pouch (10) forms rows of stitches that link with the yarn-overs (8,9) when knitting back from the end of the outward portion of the thumb pouch (7). After forming a thumb pouch (11), a five finger body (14) is knit as a circularly-knit tube wherein the knitting thread revolves in the course direction completing a glove (1).

11 Claims, 17 Drawing Sheets

U.S. PATENT DOCUMENTS 7,529,596 B2 * 5/2009 Okamoto ..... 700/141
7,577,488 B2 * 8/2009 Okamoto ..... 700/141
7,693,599 B2 * 4/2010 Okamoto ..... 700/141
2012/0000252 A1 * 1/2012 Funaki et al. ..... 66/174

* cited by examiner (b)

(c)

d1
d2
d3
d4
d5
d6
d7
d8
d9
d10
d11
B
F
a b c d e f g h i j
q r s t u v w x y z e1
e2
e3
e4
e5
e6
e7
e8
e9
e10
e11
B
F
a b c d e f g h i j
q r s t u v w x y z

TUBULAR KNITTED FABRIC AND KNITTING METHOD THEREOF

CROSS REFERENCE TO RELATED APPLICATION

This application is a 35 U.S.C. 371 National Phase Entry Application from PCT/JP2010/001113, filed Feb. 20, 2010, which claims the benefit of Japanese Patent Application Nos. 2009-042612 and 2009-239863 filed Feb. 25, 2009 and Oct. 16, 2009, the disclosures of which are incorporated herein in their entirety by reference.

The present invention relates to a tubular knitted fabric to be knitted without sewing by a flatbed knitting machine, and a knitting method thereof.

BACKGROUND ART

Conventionally, in a flatbed knitting machine, provided with at least a pair of needle beds opposed to each other interposing a needle bed gap, it is known that fabrics knitted with each needle bed are connected at both sides of knitting width and become a tubular shape as a whole if making a knitting yarn to be fed so as to round over both needle beds. Hereafter such tubular knitted fabric is to be named as a round knitted tubular fabric. By applying the round knitted tubular fabric, it becomes possible to knit firstly a glove or a sock, apparel like a sweater and so on, integrally without sewing.

An art for knitting a glove so called a mitten integrally with a flatbed knitting machine, in a state where a thumb pouch, for accommodating a thumb to be knitted as a round knitted tubular fabric, is connected within the knitting width of the mitten (for example, see Patent Literature 1). According to this art, a round knitted tubular fabric for a thumb pouch is knitted in parallel to a round knitted tubular fabric for a four finger body at separated positions to each other. Both needle beds are needed to knit a round knitted tubular fabric, so that save of stitches is difficult if overlapping of knitting needle occurs. Therefore, two round knitted tubular fabrics need to be knitted at separated positions and, after shifting the two fabrics so as to overlap each other, to be joined insides of each overlapped fabric with bind offs.

A tubular knitted fabric without sewing is able to be formed not only by rounding a knitting yarn but also by repeating flechage knits. In an outward side from a base portion to an edge portion, narrowing knitting width in series so as to remain stitches for connecting on both end sides of the knitting width, and in a homeward side from the edge portion to the base portion, widening knitting width in series so as to form stitches between the stitches for connecting remained after knitting in the outward side, a tubular knitted fabric like a finger pouch might be knitted (for example, see Patent Literature 2). Hereafter such knitted fabric is to be named as a flechage knitted tubular fabric. As for the conventional flechage knitted tubular fabric, however, its tubular width needs to be widened in order to increase its tubular height, so that it can be applicable to a finger pouch or a heel and so on of a sock but it may be difficult to apply to a finger pouch of a glove.

CITATION LIST

Patent Literature

[Patent Literature 1] U.S. Pat. No. 6,216,494

[Patent Literature 2] Japanese Laid-Open Patent Publication No. 2008-121152

DISCLOSURE OF THE INVENTION

Technical Problem

To the glove, in which the thumb pouch is connected within the knitting width of the four finger body by the method, as disclosed in the Patent Literature 1, so as to connect the round knitted tubular fabrics with each other after being knitted on separated positions, connecting portion made by the bind off process is formed inside. The glove therefore has a problem that the appearance look of the inside boundary portion between the thumb pouch and the four finger body becomes bad, the stretch is decreased to be hardened, and the wearing feel is detracted. Such a glove, in which the thumb pouch is connected within the knitting width, is a relatively high class article, so that the fashionable quality is considered to be important and the commercial value decreases if the appearance look of the boundary portion becomes bad. Such a glove, therefore, is not knitted integrally by a flatbed knitting machine, a thumb pouch and a base fabric, which is the other part than the thumb pouch, are knitted separately and are connected each other by a sewing operation in a post-process. In the base fabric a hole is to be prepared for mounting the end portion of the thumb pouch so that the thumb pouch is mounted to the base fabric by manual procedures as knitting stitches with each other between the hole and the end portion.

Such a tubular knitted fabric, in which a base fabric combines a fingertip or the like, is able to be knitted integrally by a flatbed knitting machine but is difficult to obtain a good appearance look of a boundary portion. On the other hand, a flechage knitted tubular fabric, which is formed by a knitting method like as disclosed in the Patent Literature 2, is knitted in one side of needle bed, so that it might be relatively easy to add to an intermediate portion of a round knitted tubular fabric. However in the flechage knitted tubular fabric, in order to increase the tubular height which becomes the depth as the tubular fabric, it must be necessary to widen a tubular width at base end. In a portion where the tubular width is held constant and the tubular height is increased, it is impossible to link the outward side fabric with the homeward side fabric so that a hole might open and an appearance look might be distracted. Further, the conventional flechage knitted tubular fabric is not able to be knitted to increase the tubular height with widening the tubular width. It is therefore applicable to a finger pouch of a sock or the like, but it might be bad appearance look when forming a finger pouch of a glove or the like, and it could not to increase the tubular height under holding the tubular width constant, and there might be difficult to fit a bellied region of a human body or the like.

It is an object of the present invention to provide a tubular knitted fabric and a knitting method thereof, which can be knitted without sewing by a flatbed knitting machine, and which is easily fitted to a three-dimensional shape of a wearing region without detracting the appearance.

Technical Solution

The present invention is a tubular knitted fabric to be knitted without sewing by a flatbed knitting machine, comprising:

a fold back portion to be knitted by a flechage knitting, in which reciprocating knits with respect to a course direction are repeated, and to be provided midway in the fabric knitted continuously in a wale direction, at the fold back portion the fabric being folded back and divided into both side fabrics with respect to the wale direction, so that the one side fabric is opposed to the other side fabric, and linking parts being formed with double stitches made by stitch transferring between an end portion in the course direction of the one side fabric and its opposed end portion in the course direction of the other side fabric.

The tubular knitted fabric of the present invention further comprising a part, which is formed over regions, each region belonging to said one side fabric or said other end side fabric, and being adjacent to said linking part between the both side fabrics, so as to continue more than three courses of stitches lining up in the wale direction, and which becomes a tube with a same diameter.

In the tubular knitted fabric of the present invention, a part of said end portion of at least one of said one side fabric or said other side fabric in the wale direction continues to another fabric, and in a boundary part between said one side fabric in the wale direction and said part of the end portion, stitches being continuous with respect to the wale direction.

The tubular knitted fabric of the present invention further comprising a part of fabric, which becomes a gusset, in said linking part formed between said one side fabric and said other side fabric, with respect to the wale direction.

In the tubular knitted fabric of the present invention, said one side fabric and said other side fabric with respect to the wale direction, having a shape different at least number of courses or number of stitches for corresponding courses.

The tubular knitted fabric of the present invention further comprising a finger pouch for accommodating a finger of a glove or a sock, being formed by linking between said one side fabric and said other side fabric with respect to the wale direction.

The tubular knitted fabric of the present invention further comprising a heel portion of a sock for accommodating a heel of a foot, being formed by linking between said one side fabric and said other side fabric with respect to the wale direction.

Further the present invention is a knitting method to use flatbed knitting machine provided with a function of stitch transfer, in which a flechage knitted fabric, to be knitted as a row of stitches formed by repeating of reciprocating knits in a course direction, being folded back halfway of continuous knitting in a wale direction so as to make an outward side fabric to the folded back part oppose to a homeward side fabric from the folded back part, and linking the outward side fabric with the homeward side fabric at end portions of knitting width opposing to each other, in the outward side fabric, stitches for linking, so as to hang on different knitting needles than knitting needles which hang stitches for linking added to end portions of already knitted row of stitches, while accompanying shifts for row of stitches, being knitted by repeating to add to end portions and to hang on knitting needles, and in the homeward side fabric, when row of stitches, which is predetermined to correspond to the row of stitches of the outward side fabric to be added with the stitches for linking at end potions, is knitted, end portions are linked to the stitches for linking with overlapping by stitch transfer, and knitting being repeated, while the shifts accompanying to the outward side fabric being got back.

In the knitting method of the present invention, said outward side fabric, on the way to knit different fabric which becomes a base fabric, begins to knit in a state where the base fabric pauses to be knitted, and said shift for row of stitches in said outward side fabric being done, in a direction apart out of the knitted width of the base fabric.

In the knitting method of the present invention, before said outward side fabric are knitted and linked with the homeward side fabric, a fabric for increasing thickness is added to the outward side fabric.

In the knitting method of the present invention, at least one of said outward side fabric and said homeward side fabric being knitted with shaping knit, in which widening or narrowing being done to the knitted row of stitches.

Advantageous Effects

According to the present invention, one side fabric and the other side fabric with respect to a wale direction are formed by being folded back at the fold back portion and opposed to each other, so that a tubular knitted fabric is formed by linking end portions in the course direction with double stitches, which are made by stitch transferring. Each side fabric of the tubular knitted fabric is formed by the flechage knitting, in which reciprocating knits are repeated, so that the tubular knitted fabric could be possible to be knitted without sewing in case of using only one of the both side needle beds, and it might be relatively easy to add to an intermediate portion of a round knitted tubular fabric, which is knitted by using both needle beds. The tubular knitted fabric to be added is not a round knitted tubular fabric, and it is not necessary to widen the tubular width in case the tubular height increases, so that, without sacrificing an appearance look, the added portion might increase thickness to its boundary part and then it might be possible to make it easy to fit to a three-dimensional of a wearing region.

Further according to the present invention, it could be possible to obtain a portion of a tube with a same diameter over three continuous courses, in which the knitting width is constant and the appearance look is good because there is no hole in the linking portion between the one side fabric and the other side fabric with respect to the wale direction.

Further according to the present invention, stitches are continuous in the wale direction at the boundary portion where the tubular knitted fabric continues to the other fabric, so that it could be possible to improve the appearance look of the boundary portion and the fitness to the wearing region.

Further according to the present invention, a part of fabric to become a gusset is provided in the linking part between the one side fabric and the other side fabric of the tubular knitted fabric with respect to the wale direction, so that, when worn to a region with movement or bulge and so on, it could be possible to give an elbowroom to such a region by providing depth.

Further according to the present invention, the one side fabric and the other side fabric with respect to the wale direction, which interpose the fold back portion of the tubular knitted fabric, have a shape different at least number of courses or number of stitches in the corresponding course, so that, when worn to a region like a joint and so on, it could be possible to obtain a three-dimensional shape capable of providing bulge and so on adjusted to a bending direction.

Further according to the present invention, to a glove or a sock, a finger pouch could be formed so as to improve an appearance look and a wearing feel when accommodating a finger.

Further according to the present invention, a heel portion of a sock as a flechage knitted tubular fabric could be formed with increased tubular height and with good appearance look.

Furthermore according to the present invention, using a flatbed knitting machine provided with a function of transferring stitches, a flechage knitted fabric, which is knitted by repeating reciprocating knits in a course direction, is folded back halfway of a wale direction to link end portions, so that the flechage knitted fabric can be knitted as a tubular knitted fabric. When an outward side fabric is knitted, a row of stitches to add stitches for linking is included in an end portion. In order that stitches for linking might be suspended by individually different knitting needles, a position of knitted row of stitches is shifted. In a homeward side fabric, to the stitches for linking, end stitches with predetermined correspondence are overlapped by stitch transferring and linked, and the shift of the outward side is returned, so that a knitted fabric, which becomes a tubular shape as a whole, can be formed. Such formed tubular knitted fabric, is able to be knitted by a flatbed knitting machine, which is provided with a front needle bed and a rear needle bed, using only one needle bed, without sewing but with a good appearance look of a boundary portion to link to other fabric. Moreover it is not necessary to connect tubular knitted fabrics each other in a boundary portion by the bind off process and so on, it is possible to intend time reduction for knitting.

Further according to the present invention, by using knitting needles, which exist in a direction apart from a base fabric being in pause for knitting and are not used to suspend stitches, a tubular knitted fabric with shifting stitches are knitted. For pulling downward in a needle bed gap and so on, under a state where influence from a suspending base fabric is hardly suffered, a tubular knitted fabric can be knitted.

Further according to the present invention, linking between an outward side fabric and a homeward side fabric, which interpose a fold back portion, is done by adding a fabric like a gusset for increasing thickness, so that a tubular knitted fabric can be knitted with elbowroom.

Further according to the present invention, a fold back portion is interposed by an outward side fabric and a homeward side fabric, and at least one of those fabrics is knitted by shaping knit, so that a three-dimensional shape, fitted to a wearing region, is obtained in a state with a good appearance look.

DESCRIPTION OF EMBODIMENTS

Figure 1:
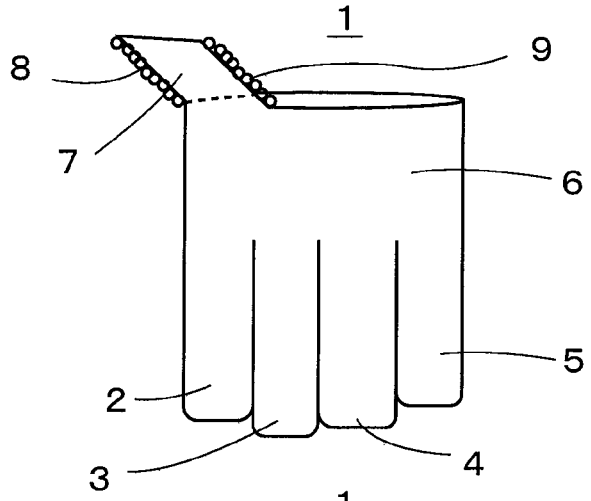
FIG. 1 is a simplified plan view showing schematically a knitting procedure for a glove 1 as the 1st embodiment of the present invention.
Figure 1:
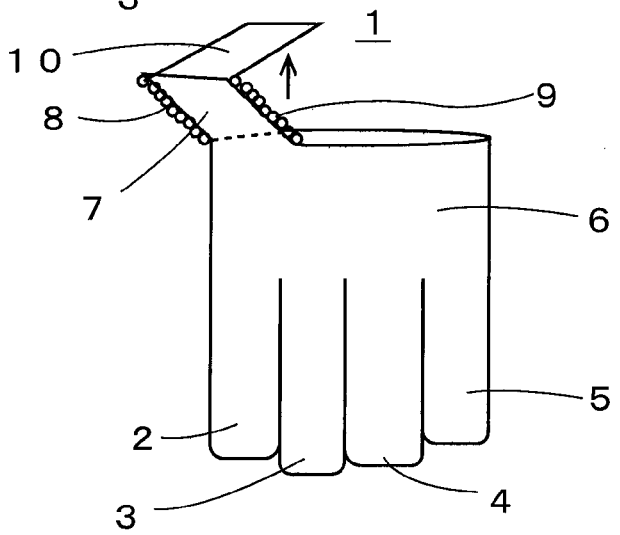
Figure 1:
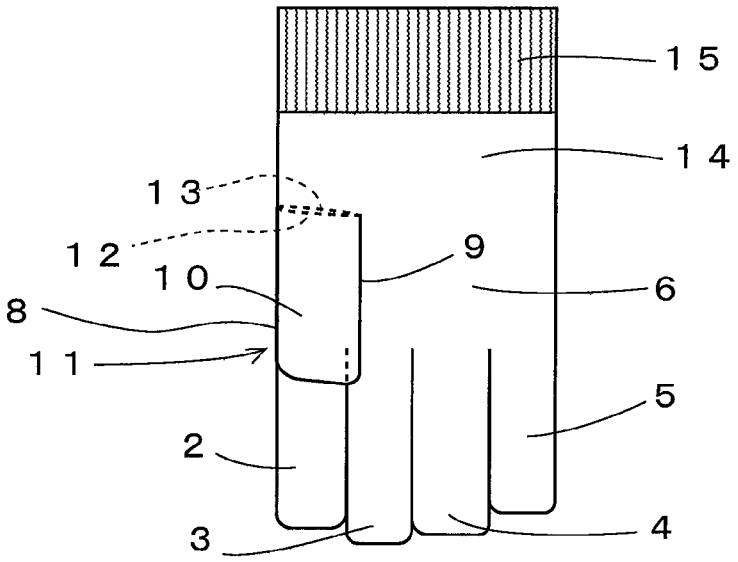

Any embodiment of the present invention as a tubular knitted fabric, which does not detract from an appearance look of a boundary portion formed by adding a thumb pouch 11 of a glove 1 as shown in FIG. 1 to a palm side to be a base fabric side, is possible to be knitted integrally with a flatbed knitting machine. In the following explanation to each embodiment, corresponding parts are shown with the same referential numeral and repeated explanation might be omitted.

Embodiment 1

FIG. 1 schematically shows a simplified procedure to knit a glove 1 integrally, as the 1st embodiment of the present invention, by using a flatbed knitting machine. For the flatbed knitting machine, that provided with at least a pair of needle beds to be opposed each other interposing a needle bed gap, and provided with functions for stitch transferring between the needle bed or for racking to displace needle beds mutually, is used. Knitting of the glove 1 should be advanced upward from finger pouches 2,3,4,5 below to a four finger body 6 and so on.

FIG. 1(*a*) shows a state in which an outward side of thumb pouch 7 has been knitted. The outward side of thumb pouch 7, for which the four finger body 6 and a five finger body 14 to be described later are to work as base fabrics, is knitted within a knitting width of a palm as a flechage knitted fabric. The finger pouches 2,3,4,5, which accommodate four fingers respectively except thumb, and the four finger body 6, are knitted as round knitted tubular fabrics in which knitting yarns made rounded in the course direction. The outward side of thumb pouch 7 is continuous to an end portion in the wale direction and is knitted by repeating reciprocation in the course direction. In the outward side of thumb pouch 7, rows of stitches are knitted so as to be provided with a plurality of stitches inside each row, and hanging stitches 8,9 are added respectively to both side of each row so as to become stitches for connection and so as to be capable of connection at both side of the row of stitches. The hanging stitches 8,9 may be stitches formed by split knit. In order to vary knitting needles to suspend added hanging stitches 8,9, positions of the row of stitches are shifted so as to be steered to a side apart from the end portion of the four finger body 6. Forming of the hanging stitches 8,9 or the stitches to be connected to both side of the row of stitches, might be done with a needle bed whether suspending the row of stitches or not, a close position should be preferable in relationship to floating yarns.

FIG. 1(*b*) shows a state in which a homeward side of thumb pouch 10 has been knitted so as to be folded back from the edge portion of the outward side of thumb pouch 7. However described below, after continuing to knit the homeward side of thumb pouch 10, the row of stitches, which has been displaced to left side of the drawing by knitting the outward side of thumb pouch 7, would be returned to right side of the drawing. In each course of the homeward side of thumb pouch 10, a row of stitches is formed so as to link the interval between the hanging stitches 8,9, which are formed at the both side with respect to the row of stitches knitted as each course in the outward side of thumb pouch 7 opposing to the homeward side of thumb pouch 10, and directions to form the rows of stitches are reciprocated by reversing the direction after each course. The outward side of thumb pouch 7 and the homeward side of thumb pouch 10 are linked by overlapping stitches at both side of the course direction in each flechage fabric respectively, and become a tubular knitted fabric as a whole.

FIG. 1(*c*) shows a part, which is knitted after a thumb pouch 11 is formed to be a tubular fabric with the outward side of thumb pouch 7 and the homeward side of thumb pouch 10. Boundaries between the thumb pouch 11 and a base fabric become an outside boundary part 12 and an inside boundary part 13. At the inside boundary part 13, stitches are continuous in the wale direction between the four finger body 6 and the outward side of thumb pouch 7. From the inside boundary part 12, so as to continue stitches in the wale direction of the homeward side of thumb pouch 10, a five finger body 14 and a wrist portion 15 are knitted in a tubular shape by making knitting yarns round in the course direction and completed as the glove 1. For the inside boundary part 13, there is no need to bind off process and so on, it can be possible to improve appearance look and to cut down time to knit.

Figure 2:
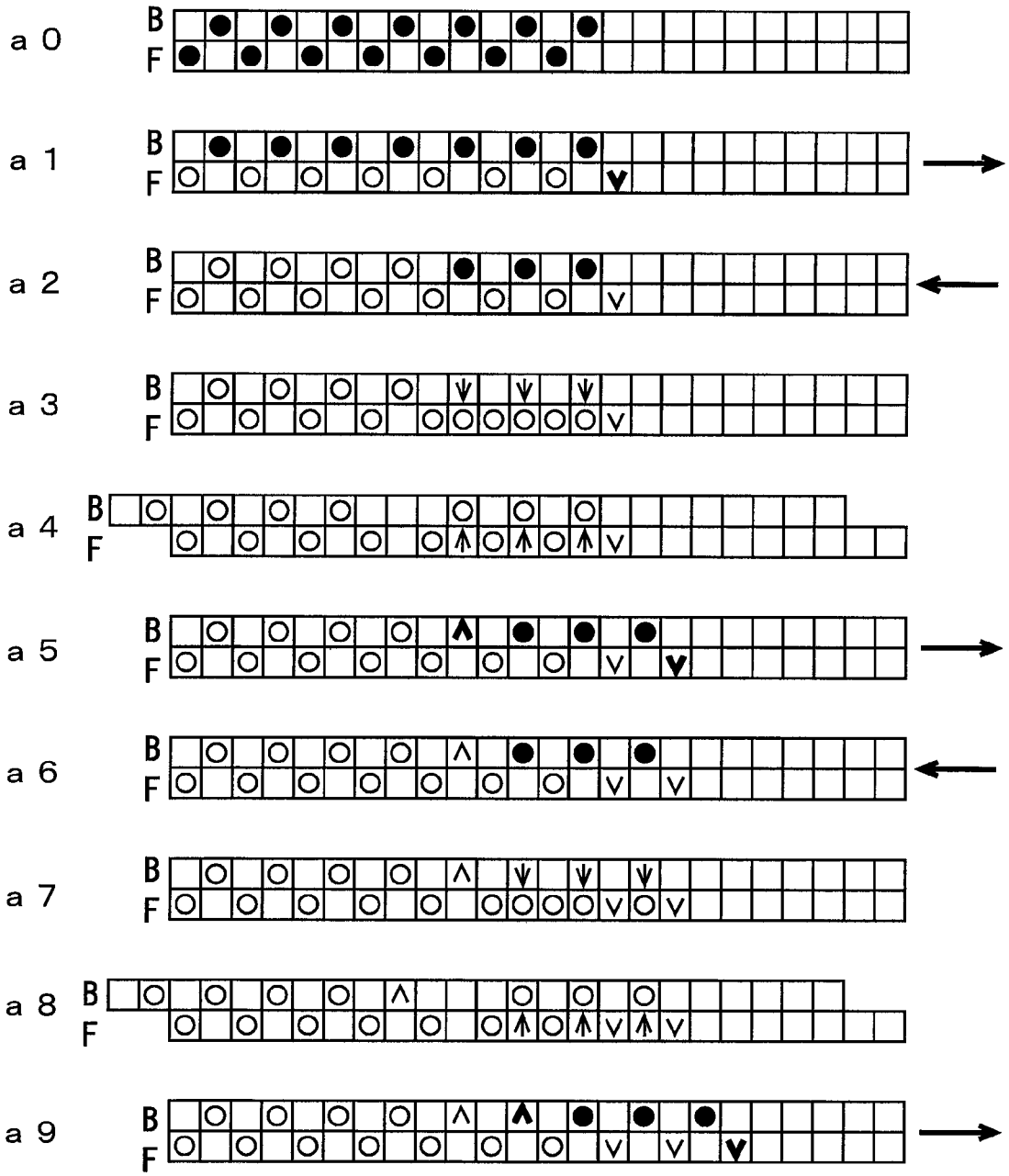
FIG. 2 is a knitting diagram showing schematically a knitting procedure to knit an outward side of thumb pouch 7 of FIG. 1 with a flatbed knitting machine.
Figure 3:
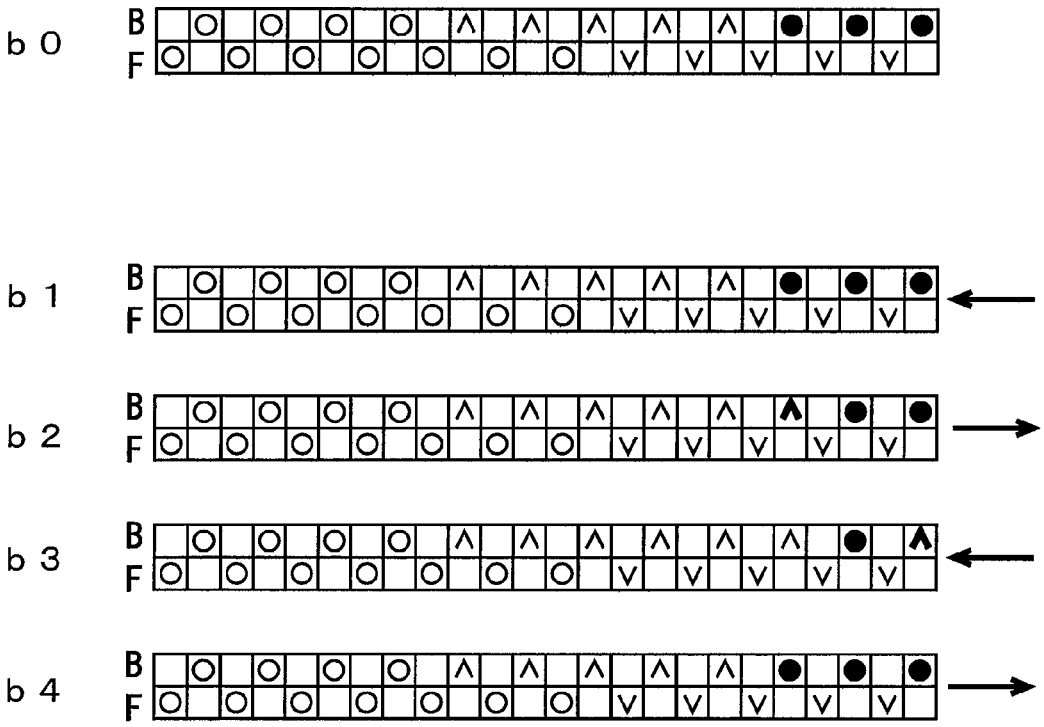
FIG. 3 is a knitting diagram showing schematically a forming procedure from the outward side of thumb pouch 7 to a homeward side of thumb pouch 10 of FIG. 1 by folding back with a flatbed knitting machine.
Figure 4:
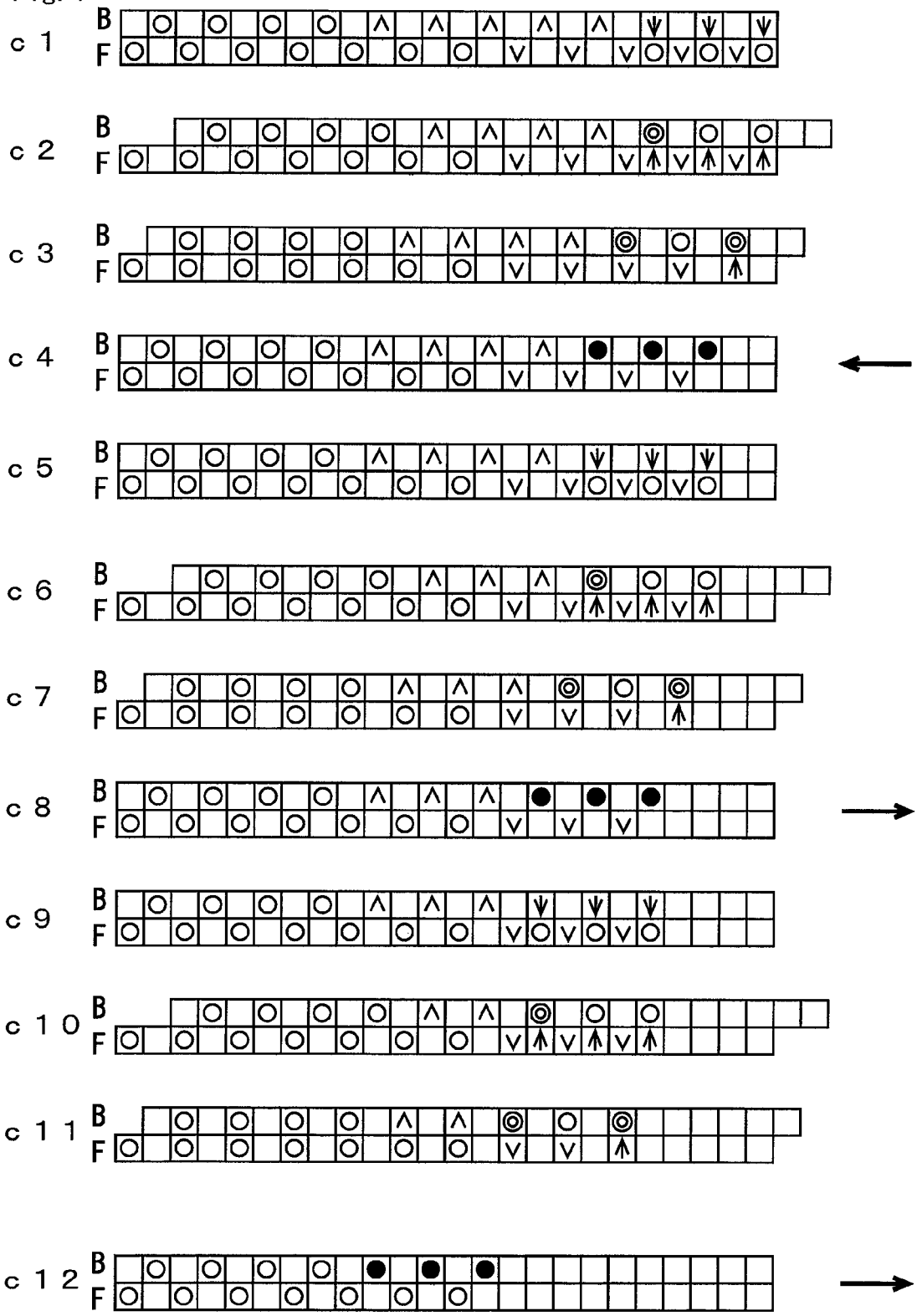
FIG. 4 is a knitting diagram showing schematically a knitting procedure to knit the homeward side of thumb pouch 10 with a flatbed knitting machine.

FIG. 2, FIG. 3 and FIG. 4 show an example of more precise procedure used when the thumb pouch 11 of FIG. 1 is knitted with a flatbed knitting machine. In each drawing, 'B' and 'F' denote a rear needle bed and a front needle bed respectively. A grid cell denotes individual knitting needle. A blank grid cell shows that the corresponding knitting needle is an empty needle. A black circle mark in a grid cell shows a newly knitted stitch. A white circle mark in a grid cell shows a stitch suspended by the corresponding knitting needle, A 'V' shaped mark in a grid cell shows a hanging stitch for a knitting needle not in use and shows a tuck for a knitting needle hanging a stitch. A newly formed hanging stitch or a tuck, the 'V' shaped mark is drawn with a fat line. A double circle in a grid cell shows an overlapped stitch. An arrow in a grid cell shows a stitch transfer. An arrow illustrated in the right side of the drawing shows a direction for stitches to be knitted as its course direction. In addition, number of knitting needles to be used or of courses to be knitted is convenient one, so that in case a fabric is actually to be knitted, more number is used in general. Further the example is shown as that, from the finger pouch 5 for the fifth finger to the finger pouch 2 for the second finger are knitted with both the front and the rear needle bed so as to head to left side of the needle bed to right side. a palm side is knitted with the rear needle bed 'B' and a back of hand side is knitted with the front needle bed 'F' respectively, and the thumb pouch 11 is knitted by using mainly stitches of the rear needle bed 'B'.

FIG. 2 shows a procedure for knitting the outward side of thumb pouch 7 of FIG. 1. 'a0' course shows a state in which the four finger body 6 has been knitted as a round knitted tubular fabric with using the front needle bed and the rear needle bed. Knitting needles are used basically in a half gauge state. 'a1' course shows a state in which, with feeding knitting yarn to right ward, a row of stitches for the last course of the four finger body 6 is formed on the rear needle bed 'B' and a hanging stitch is finally formed at the right end of the knitting width in the front needle bed 'F'. 'a2' course shows a state in which, with feeding knitting yarn to left ward reversed to the direction of 'a1' course, a row of stitches for the first course of the outward side of thumb pouch 7 is formed on the three knitting needles in the right side of the rear needle bed 'B'. A hanging stitch, which is at right side to the row of stitches for the first course, has been knitted previously in 'a1' course. 'a3' course shows a stitch transferred state, in which the stitches formed on the three knitting needles in the right side of the rear needle bed 'B' are transferred to empty needles in the front needle bed 'F'. 'a4' course shows a state, in which after racking the rear needle bed 'B' to shift at two needles to the front needle bed 'F', the stitches transferred in 'a3' course are returned to the rear needle bed 'B' by transferring from the front needle bed 'F'. From 'a3' course to 'a4' course, the row of stitches formed on the three knitting needles in the right side of the rear needle bed 'B' are shifted right ward at two needles. Between the shifted row of stitches and the row of stitches which is not shifted, an empty needle is generated. In 'a5' course, displacement of the rear needle bed 'B' to the front needle bed 'F' is got back, and then with feeding knitting yarn to right ward, a hanging stitch is formed by using the empty needle. Following to form the hanging stitch at the left side, a row of stitches, which becomes the second course for the outward side of thumb pouch 7, is knitted. At the right side to the row of stitches to be the second course, a hanging stitch is formed in the front needle bed 'F'. This hanging stitch is to be formed at an empty needle so as to be more right side than the hanging stitch formed to be right side to the first course.

In 'a6' course, with feeding knitting yarn to left ward reversed to the direction of 'a5' course, a row of stitches for the third course of the outward side of thumb pouch 7 is formed. In 'a7' course, the stitches formed in 'a6' course are transferred from the rear needle bed 'B' to the front needle bed 'F'. In 'a8' course, the rear needle bed 'B' is shifted left ward at two needles to the front needle bed 'F' and then the stitches transferred in 'a7' course are got back from the front needle bed 'F' to the rear needle bed 'B' so that an empty needle is generated. In 'a9' course, displacement of the rear needle bed 'B' to the front needle bed 'F' is got back, and then a hanging stitch is formed by using the empty needle. Following the hanging stitch, a row of stitches, which becomes the fourth course for the outward side of thumb pouch 7, is knitted, and at right side a hanging stitch is formed on an empty needle in the front needle bed 'F'.

Among above procedures, the rows of stitches for the outward side of thumb pouch 7, formed in 'a2' course, 'a5' course, 'a6' course and 'a9' course, become four courses of fabric, in which the knitting width is constant and the stitches adjacent to the linking part are continuous in the wale direction. In the conventional flechage knitted tubular fabric, if the knitting width is constant, it is not possible to provide a plurality of stitches continuous for linking so that, in case a row of stitches having a constant knitting width is knitted over three courses, a hole is generated in the linking part. Additionally in the 1st embodiment, the rows of stitches are knitted with the rear needle bed 'B', and the both side stitches are knitted so as to form left side ones on the rear needle bed 'B' and right side ones on the front needle bed 'F'. Knitting needles, to which stitches for linking are formed, are opposed, with interposing the needle bed gap, to a needle bed, which having empty needles so that it may be possible to form stitches for linking on the empty needles. Further it may be possible to form stitches for linking on empty needles adjacent to the row of stitches un the same needle bed and then to transfer the stitches for linking.

FIG. 3 shows a knitting procedure to make a fingertip of a thumb pouch 11 by a flechage knit without shift for row of stitches, at the time when the outward side of thumb pouch 7 is folded back to the homeward side of thumb pouch 10 as shown in FIG. 1(*b*). 'b0' course shows a state in which, to a row of stitches formed by repeating the procedure of FIG. 2 on three knitting needles on right side of the rear needle bed 'B', left side hanging stitches on the rear needle bed 'B' and right side hanging stitches on the front needle bed 'F', are suspended respectively on five of knitting needles different form each other. In case fold back is done here, with a tubular width of three stitches in the course direction and with a tubular height of five stitches in the wale direction, a tubular knitted fabric with a constant diameter is could be formed. As for the tubular width by changing number of stitches in the row of stitches to the course direction, and as for the tubular height by changing number of hanging stitches, it is able to adjust respectively.

In 'b1' course, stitches are formed on three knitting needles on right side of the rear needle bed 'B'. In 'b2' course, within stitches formed in 'b1' course, a tuck is knitted on the left side needle and stitches are formed over the two other stitches. In 'b3' course, a tuck is knitted over the stitch suspended on the right side stitch of the two knitting needles. In 'b4' course, stitches are formed on the three knitting needles. The left side and the right side knitting needles out of the three knitting needles, a stitch is formed over the double stitches formed by the tuck knit so that the stitch is got back to an ordinary one. As described here, such a technique to add a flechage knitted tubular fabric so as to increase stitches in the central par, is generally done in order to add roundness to a fingertip.

FIG. 4 shows a procedure to form the thumb pouch 11 in a tubular shape while knitting the homeward side of thumb pouch 10 of FIG. 1. In 'c1' course, the stitches suspended on the three knitting needles on the right side of the rear needle bed 'B' are transferred to the front needle bed 'F'. In 'c2' course, the rear needle bed 'B' is shifted right ward at two needles to the front needle bed 'F' and then the stitches transferred in 'c1' course are got back from the front needle bed 'F' to the rear needle bed 'B' so that the right end of the row of the hanging stitches is overlapped to the left end of the row of stitches. In 'c3' course, the rear needle bed 'B' is got back to a state in which the rear needle bed 'B' is displaced at one needle left ward to the front needle bed 'F', and then the right end of the row of the hanging stitches is transferred to the rear needle bed 'B' so that it is overlapped on the right end of the row of stitches. In 'c4' course, the displacement of the rear needle bed 'B' to the front needle bed 'F' is got back, and then stitches are formed on the right side three knitting needle of the rear needle bed 'B'. By this knitting, the first row of stitches after fold back is linked. That is, a linking part is formed with double stitches by stitch transferring. Both side of the row of stitches, four hanging stitches respectively remaining states turn out.

In 'c5' course, 'c6' course, 'c7' course and 'c8' course, as like to 'c1' course, 'c2' course, 'c3' course and 'c4' course respectively, overlapping between hanging stitches and stitches, and forming new stitches are done. Both side of the row of stitches, three hanging stitches respectively remaining states turn out. As follows, in c9' course, 'c10' course and 'c11' course, similar operations as like to 'c1' course, 'c2' course and 'c3' course' course respectively are done, while shifting the rear needle bed 'B' so as to the position, where stitches are formed on the right side three knitting needle, is got back, and then with the row of stitches the interval between the hanging stitches 8,9 formed in the outward side of thumb pouch 7. Finally as shown 'c12' course, the position of the three knitting needles to suspend the row of stitches is got back within the knitting width of the rear needle bed 'B' in 'a0' course.

As described above, the thumb pouch 11 is knitted in the outward side in combination of knitting rows of stitches, hanging stitches and stitches transferring, so as to shift the rows of stitches and to form hanging stitches both side of the rows of stitches, while repeating reciprocation in the course direction. In the homeward side after the fold back at the edge portion, while repeating reciprocation in the course direction, linking interval between the hanging stitches with forming the double stitches by stitch transferring, getting back the shifted rows of stitches, and then forming a tubular knitted fabric from the edge portion in series.

Figure 5:
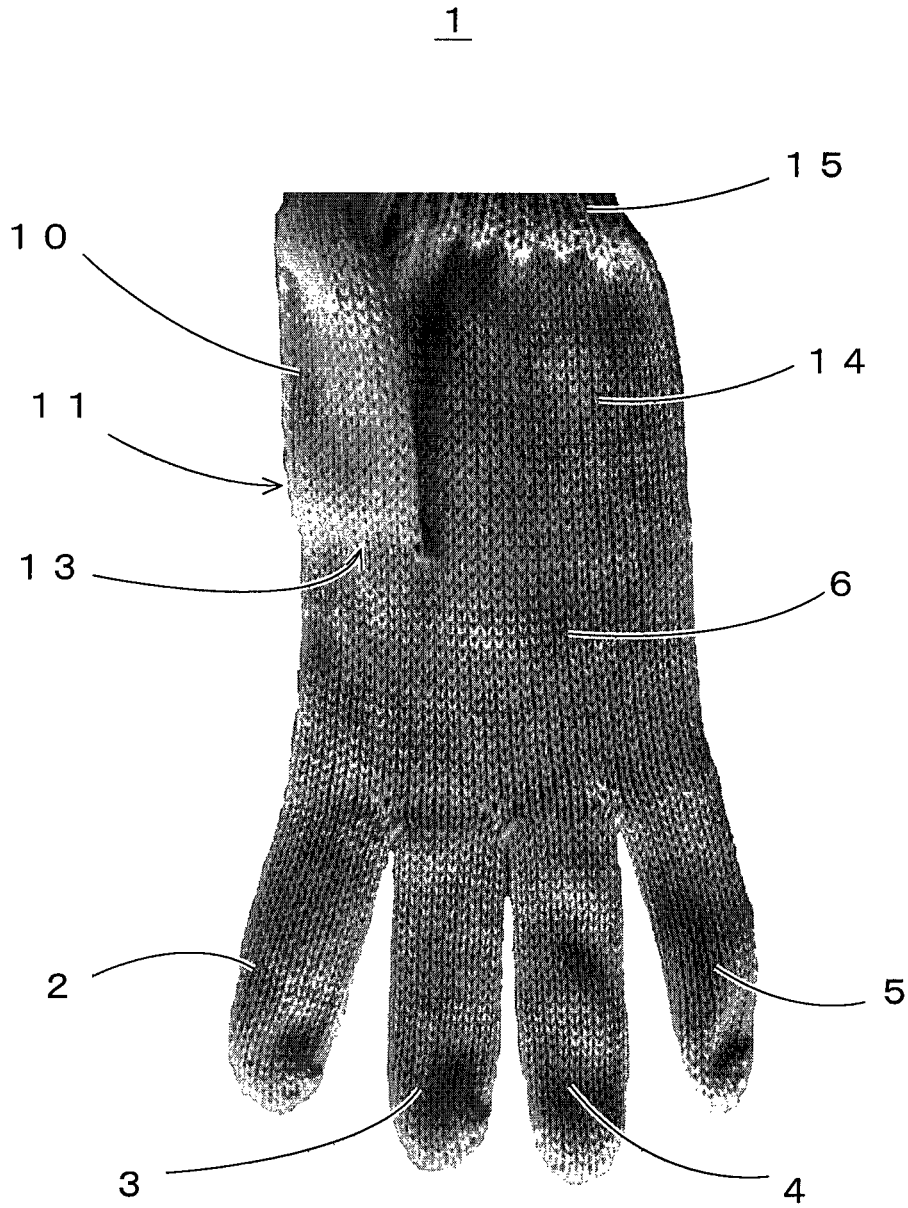
FIG. 5 is a plan view showing a state where a thumb pouch 11 opens to a wrist portion 15 side in the glove 1 of FIG. 1.

FIG. 5 shows a state in which the thumb pouch 11 is opened to the wrist portion 15 side with respect to the glove 1 of FIG. 1. As the outward side of thumb pouch 7 is knitted in a manner that its stitches continue to the four finger body 6 in the course direction so that an appearance look of the inside boundary part 13 can be improved.

Figure 6:
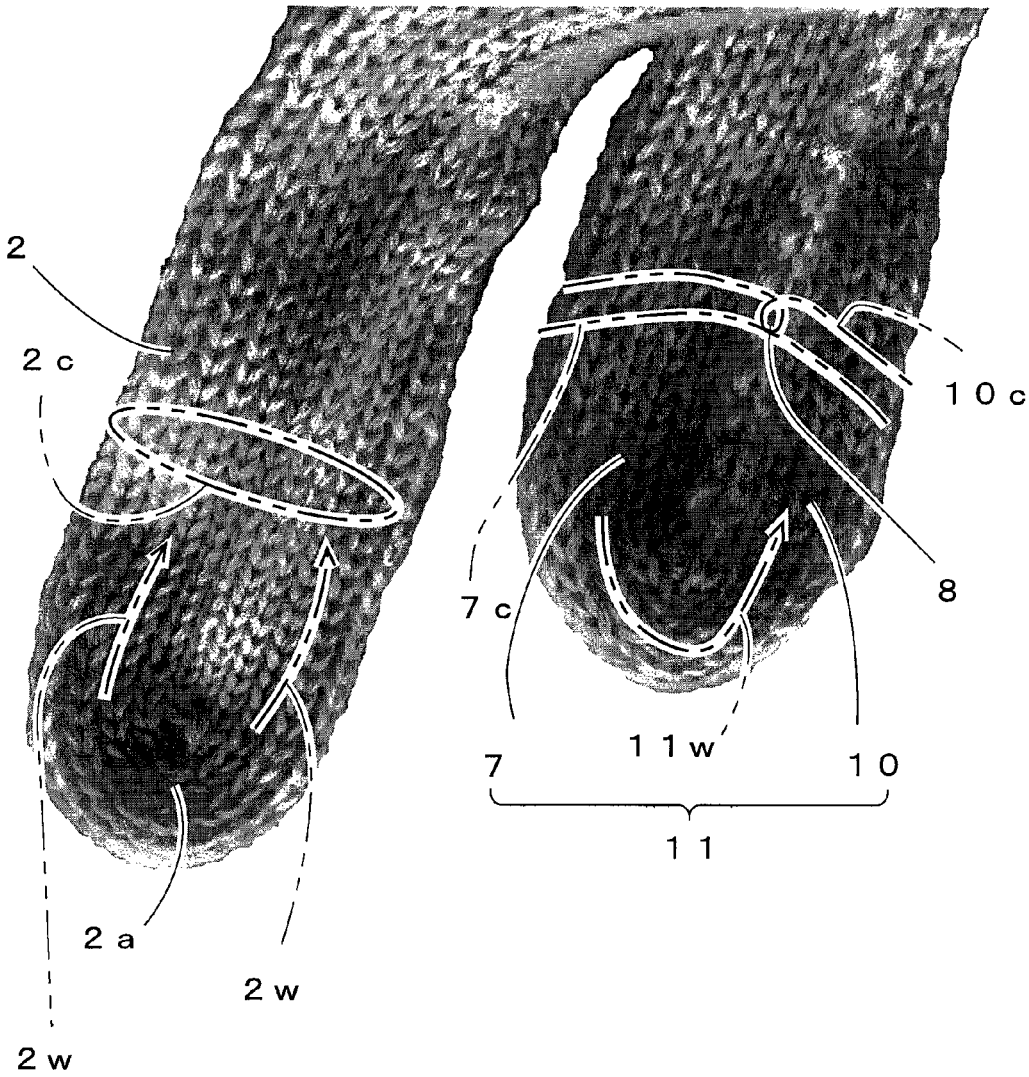
FIG. 6 is a partial plan view showing a finger pouch 2 as a round knitted tubular fabric of the glove 1 of FIG. 1 and the thumb pouch 11 as a tubular knitted fabric with row of stitches shift in a state to compare stitches.

FIG. 6 shows a stitch structure in the vicinity of the edge portion of the thumb pouch 11 with respect to the glove 1 of FIG. 1 in a state to line up with that of the finger pouch 2 for the second finger. In the finger pouch 2, following to a set up part 2*a* on the edge part, courses 2*c* are knitted so as to round, so that a wale 2*w* heads from the set up part 2*a* to the base end side of the finger pouch 2. In the thumb pouch 11, a wale 11*w* continues with fold back from the outward side of thumb pouch 7 to the direction of the homeward side of thumb pouch 10. The courses 7*c*, 10*c* of the outward side of thumb pouch 7 and homeward side of thumb pouch 10. repeat reciprocation so as to be linked with the hanging stitches 8. Both side of a boundary portion at which linking is made with hanging stitches 8, fabrics of the outward side of thumb pouch 7 and the homeward side of thumb pouch 10 become tubular fabrics in which over three courses of stitches are continuous in the wale direction 11*w* with the same diameter.

Embodiment 2

Figure 7:
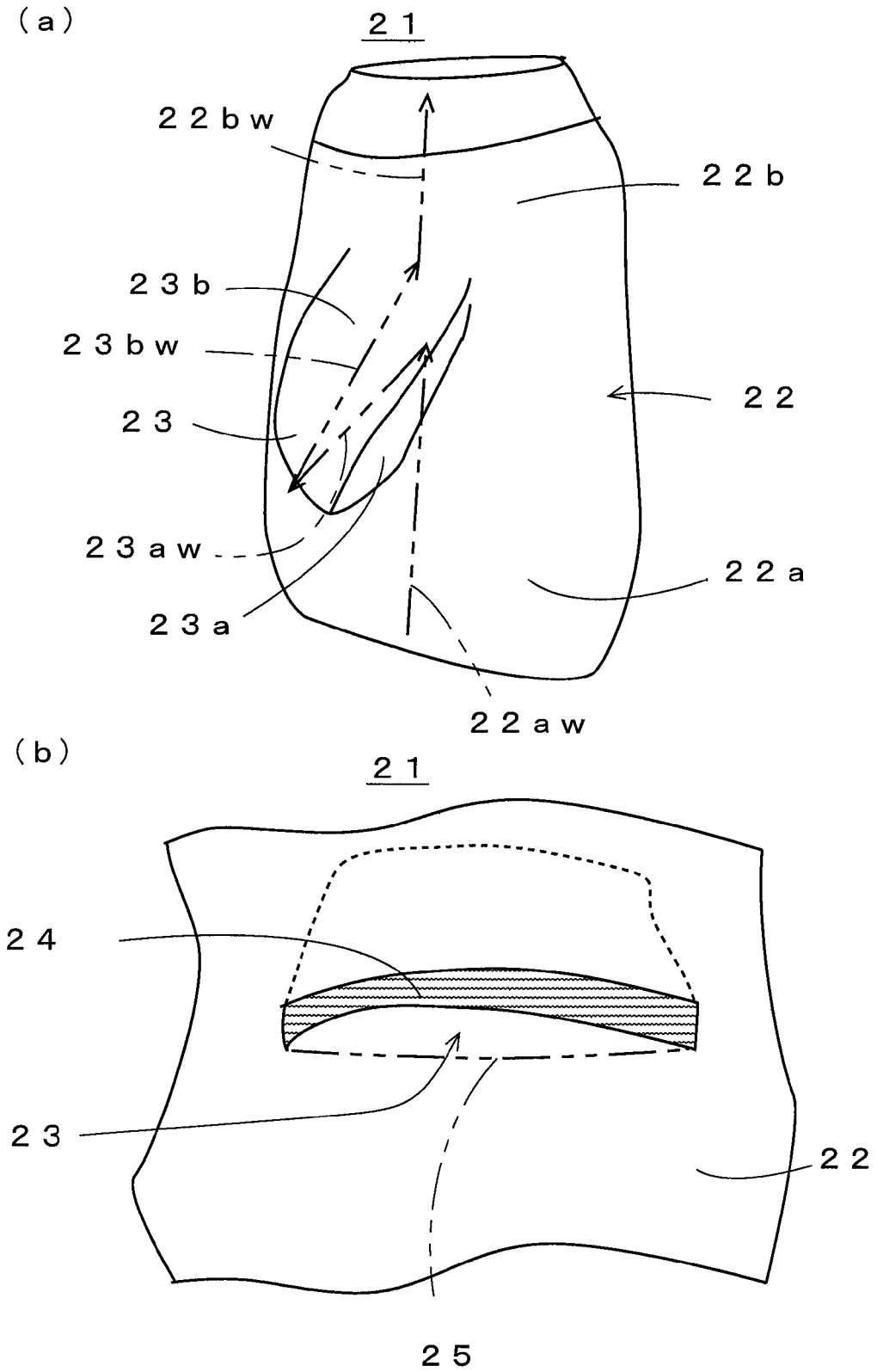
FIG. 7 is a perspective view showing an appearance structure of a knitted fabric 21 as the 2nd embodiment of the present invention in a simplified state.

FIG. 7 shows a schematic structure of a knitted fabric with pocket 21 as the 2nd embodiment of the present invention. In the knitted fabric with pocket 21, to intermediate portion of a base fabric 22 which is knitted in a tubular shape by round feeding of knitting yarn in a course direction, a tubular fabric of a pocket 23, to which the present invention is to be applied, is appended.

In FIG. 7(*a*), a direction of wale, when the knitted fabric with pocket 21 is knitted, is shown with chain double-dashed lines associating arrows. An anterior half side 22*a* is knitted in a tubular shape as shown with a wale direction 22*aw*, from downward to upward of the drawing. As reached to the position at which the pocket 23 is to be appended, knitting of the base fabric 22 pauses, the pocket 23 is knitted in a tubular shape. The pocket 23 is knitted in a manner that an outward side 23*a* and a homeward side 23*b* are knitted so as to fold back at the edge portion as shown by wale directions 23*aw*, 23*bw*. The outward side 23*a* is knitted, so as to remain hanging stitches on both side of a course direction, with shifting rows of stitches, and the homeward side 23*b* is knitted, so as to link hanging stitches, with getting back the shifted rows of stitches. After finishing to knit the pocket 23, a posterior side 22*b* of the base fabric 22 is knitted in tubular shape by rounding knitting yarn.

In addition, when a tubular knitted fabric like the pocket 23 is knitted to midway of the base fabric 22 in the course direction 22, it is preferable to make knitting needles of one needle bed side empty. For this purpose, a row of stitches to form the pocket 23 might be shifted to the end portion, by rotating stitches, from the knitting needles to suspend the base fabric 22 on one side of the course direction, into the opposing needle bed, and if necessary, the stitches might be got back after forming the pocket 23.

FIG. 7(*b*) shows a state in which the pocket 23 is pressed into the inside of the base fabric 22. To an outside boundary part 24, a patterned fabric is attended but stitches are continuous to a wale direction. As is similar to an inside boundary part 25, it becomes a state in which stitches are continuous to a wale direction.

In addition, although as a base fabric 22 an example of a fabric formed in a tubular shape by round knit is simply shown, the present invention is able to be likely applied to clothes to be worn on an upper half of the body or a lower half of the body, or on a entire body, formed integrally with a flatbed knitting machine. Further, in case a base fabric knitted as parts for such clothes is not a flechage knitted tubular fabric nor a tubular knitted fabric, but is to be attended a tubular knitted fabric, the present invention can be applied likely.

Embodiment 3

Figure 8:
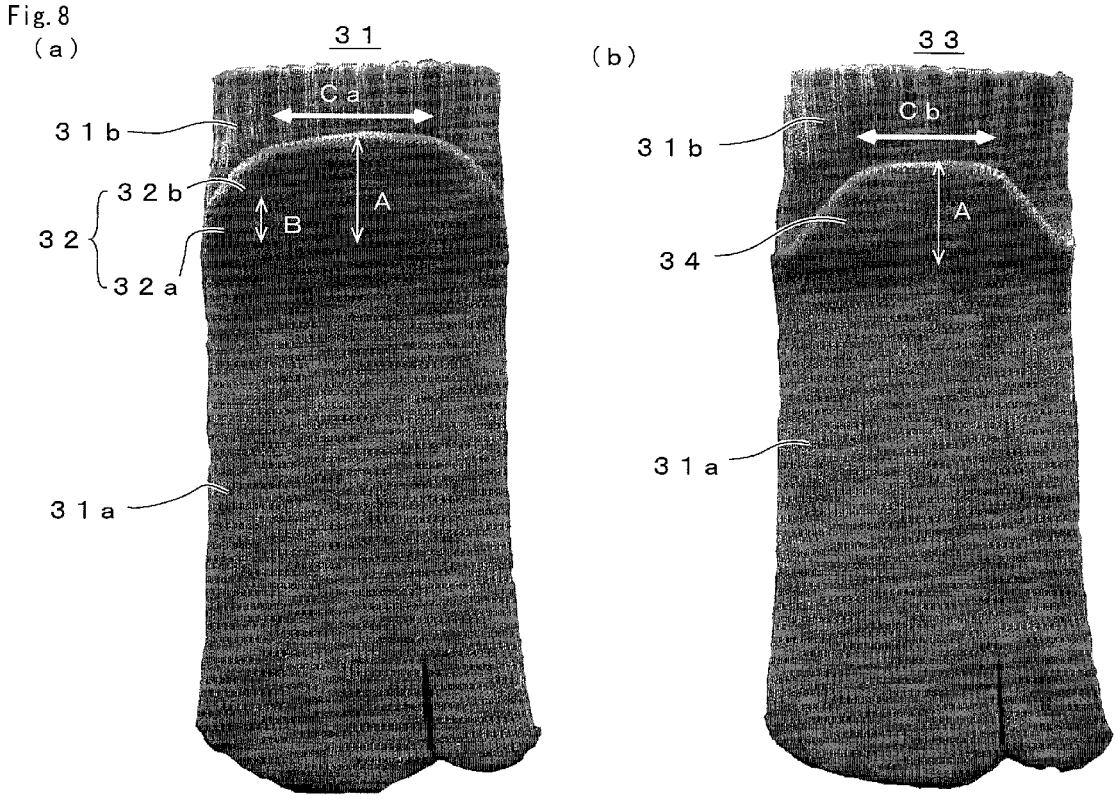
FIG. 8 is a plan view showing a sock 31 as the 3rd embodiment of the present invention in comparison with a conventional sock 33.

FIG. 8 shows a sock 31 of (a) as the 3rd embodiment of the present invention in comparison with a conventional sock 33 of (b). The socks 31, 33 are provided with heels 32, 34 respectively. The heels 32, 34 are knitted halfway of knitting the socks 31, 33, which become base fabrics, from a toe side 31*a* to an ankle side 31*b* as a round knitted tubular fabric. The heel 32, to which the present invention is to be applied, includes a constant knitting width portion 32*a*. With shifting rows of stitches, the constant knitting width part 32*a* is can be knitted as a tubular knitted fabric, in case even the flechage knit is used. A decrease knitting width portion 32*b* is able to be knitted as the conventional flechage knitted tubular fabric without shifting the row of stitches, in a state where an outward side fabric of the constant knitting width portion 32*a* has been knitted. A homeward side of the constant knitting width portion 32*a* is knitted, after knitting the decrease knitting width portion 32*b*, so as to get back the rows of stitches shifted in the outward side. The heel 34 is knitted as the conventional flechage knitted tubular fabric as a whole.

Supposing A is a tubular height necessary as the heels 32, 34, in the heel 32, B out of A is knitted with the constant knitting width part 32*a*, so that the tubular width Ca of the edge end of the heel 34 can be widened, and an elbowroom can be obtained in heel portion. In the heel 34, to the whole of the tubular height A, the flechage knitting is done with decreasing the knitting width so that the tubular width of the edge end of the heel 34 narrows.

Embodiment 4

Figure 9:
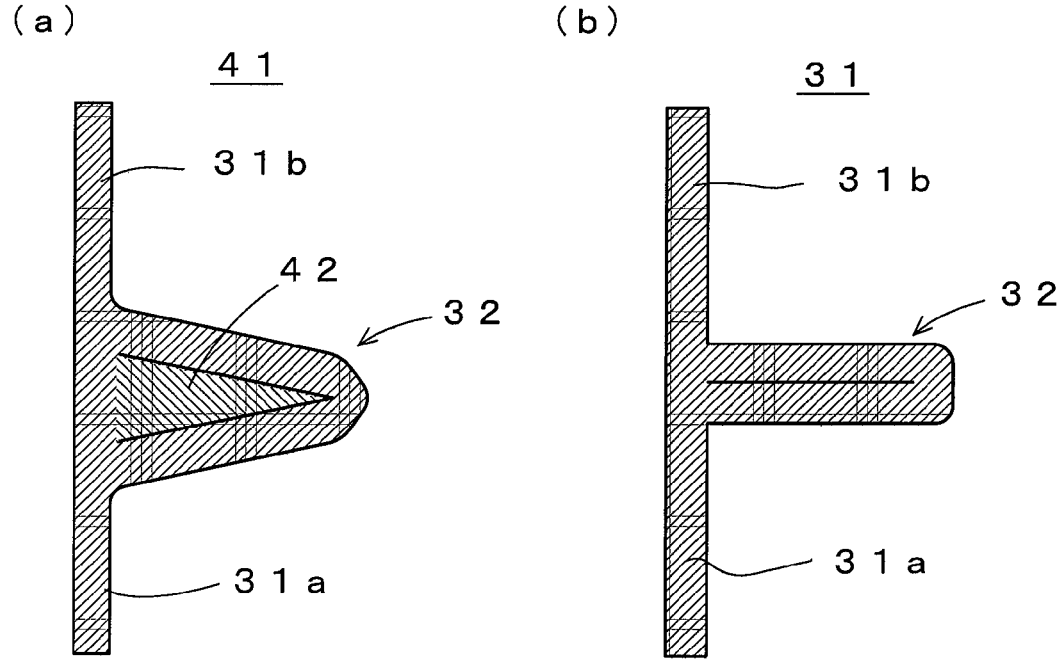
FIG. 9 is a side view showing a part of a sock 41 as the 4th embodiment of the present invention in comparison with the sock 31 of the 3rd embodiment.

FIG. 9 shows a part of a sock 41 as the 4th embodiment of the present invention in comparison with the sock 31 of the 3rd embodiment. The sock 41 shown in (a) is appended a gusset 42 to the heel 32 of the sock 31 shown in (b). That is, before the heel 32 is linked on the way it is knitted as the tubular fabric with shifting rows of stitches, stitches to be a gusset 42 are knitted in, so that the gusset 42 is to lie in a portion to link the outward side and the homeward side of the tubular knitted fabric.

Figure 10:
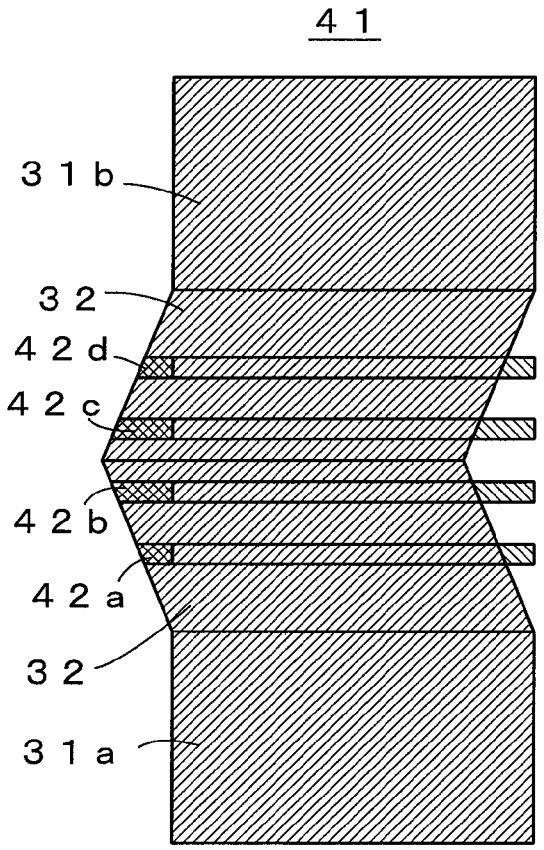
FIG. 10 is an illustration showing a state of a fabric in the middle of a procedure to knit the sock 41 of FIG. 9(*a*).

FIG. 10 shows a state of a fabric in the middle of a procedure to knit the sock 41 of FIG. 9(*a*). The gusset 42 can be divided into a plurality of parts 42*a*, 42*b*, 42*c*, 42*d*, which are knitted with simultaneous proceeding, while the heel 32 is knitted on an outward side and on a homeward side. When the parts 42*a*, 42*b*, 42*c*, 42*d* of the gusset 42, the round knit is done, and a fabric to become the heel 32 is knitted, as well as a part of fabric for an instep of foot side, Further, after the outward side of the heel 32 is knitted, the gusset 42 can be formed as a whole in a lot, and then a homeward side of the heel 32 can be knitted. The shape of the gusset 42 is freely adjustable, as to a triangle or a rectangle.

Figure 11:
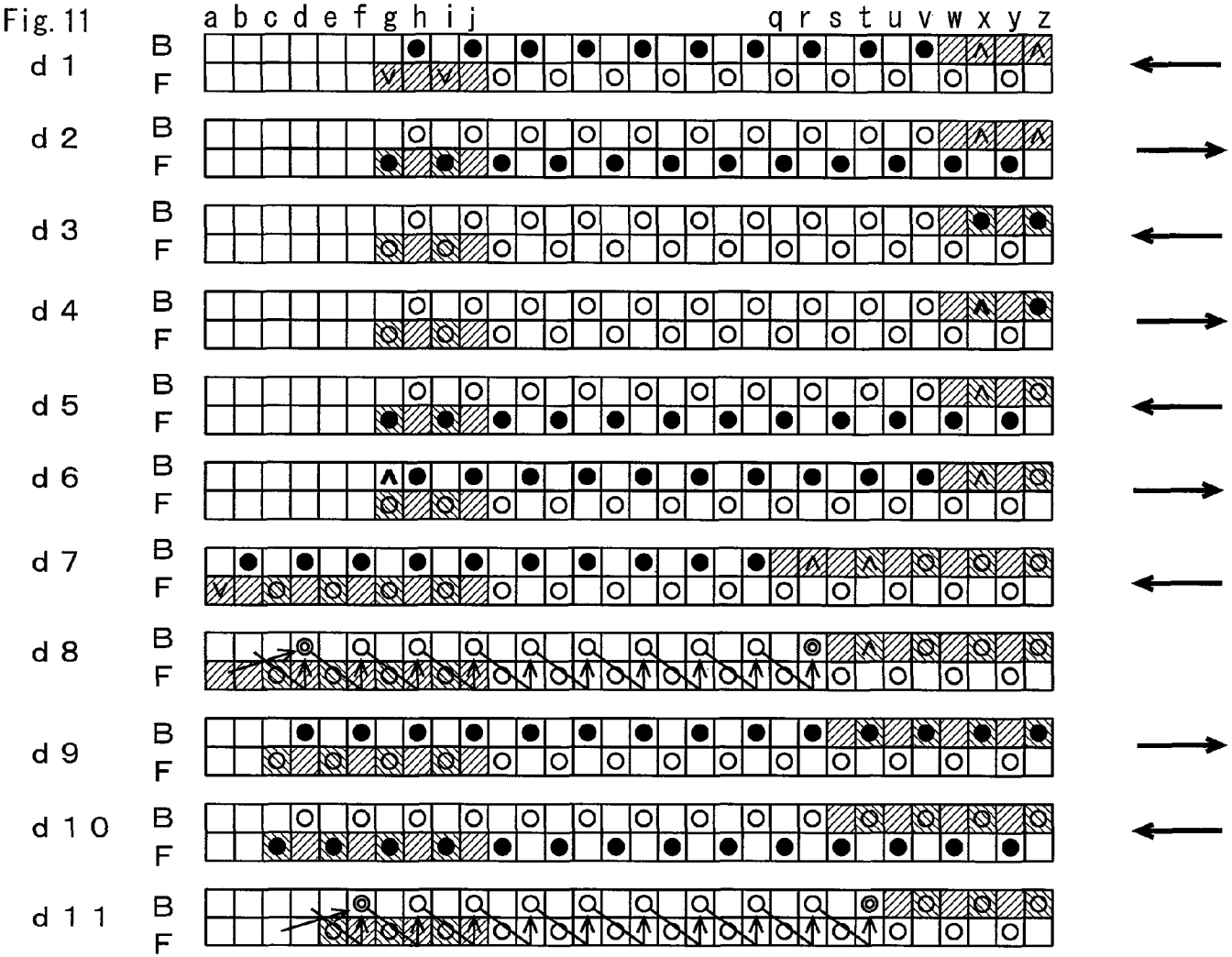
FIG. 11 is a knitting diagram showing a part of a knitting procedure of FIG. 10.

FIG. 11 shows a part of the knitting procedure according to FIG. 10, as a knitting diagram. As a knitting diagram, basically, FIG. 11 is shown as well as FIG. 2, FIG. 3 and FIG. 4, except for number of knitting needles, so that the number differs. Further, knitting needles relating to link are shown by shading diagonally right up, and knitting needles for forming gussets are shown by shading diagonally right down. Moreover, positions of knitting needles relating to the link or the gusset, are denoted with appended symbols as 'a' to 'j' for left side and as 'q' to 'z' for right side.

In the sock 41 is knitted, on the way the toe side 31*a* is knitted as the round knitted tubular fabric with using both of the front needle bed and the rear needle bed of a flatbed knitting machine, the heel 42 is knitted as a tubular fabric which continues to whole row of stitches suspended on one needle bed. At a point that the fabric of the tubular width is knitted using whole knitting width of the rear needle bed 'B' suspending the fabric of the sole of the toe side 31*a*, this is different from the thumb pouch 11 of the 1st embodiment which uses a part of the knitting width. Except such a different point, it can be reached to 'd1' course, from similar state as 'a0' course of FIG. 2 for the toe side 31*a*, that it is repeating to form hanging stitches on end portion and to shift stitches, while the outward side of the heel 32 is knitted on the rear needle bed 'B'. 'd1' course is a state, in which on the knitting needles of the positions 'g', 'i' in the front needle bed 'F', hanging stitches for linking left side are suspended, and on the knitting needles of the positions 'x', 'z' in the rear needle bed 'B, hanging stitches for linking right side are suspended.

In the next 'd2' course, with right ward yarn feeding to the front needle bed 'F, stitches to be a part for the part 42*a* of gusset 42' are formed on the knitting needles of the position 'g', 'i'. On knitting needles right side the position 'j', a row of stitches to be an outward side is formed. In the next 'd3' course, with left ward yarn feeding to the rear needle bed 'B', stitches for the part 42*a* of the gusset 42 are formed on the knitting needles of the positions 'z', 'x'. In the next 'd4' course, with right ward yarn feeding to the rear needle bed 'B', a tuck is made on the knitting needle of the position 'x' and a stitch for the part 42*a* of the gusset 42 is formed on the knitting needle of the position 'z', In the next 'd5' course, with left ward yarn feeding, including knitting needles of the positions 'i', 'g', a row of stitches for the outward side of the heel 32 and the stitches for the part 42*a* of the gusset 42 are formed. In the next 'd6' course, with left ward yarn feeding to the front needle bed 'F', a hanging stitch for linking left side is formed on the knitting needle of the position 'g' and the row of stitches for the outward side of the heel 32 on the knitting needles from the position 'h' to the position 'v'.

By such procedures shown from 'd2' course to 'd6' course, the part 42*a* of the gusset 42 shown in FIG. 10 can be knitted by two stitches to left side and by two stitches to right side, for two courses. As follows in a similar way, the part 42*b* of the gusset 42 is knitted, for example, by four stitches to left side and by four stitches to right side, for two courses, so that the outward side of the gusset 42, which includes the outward side of a triangular gusset, can be knitted. Although the part 42*a*, 42*b* are different in the number of stitches like as two stitches and four stitches, in case the numbers of stitches are equal, a rectangular gusset can be formed.

'd7' course shows a state in which, with left ward yarn feeding to the rear needle bed 'B', an outward side fabric of the heel 32 is knitted to the extent of the last course shown in FIG. 10. In the following course, folded back, and with right ward yarn feeding to the rear needle bed 'B', the first course of the homeward side for the heel 32 is knitted. In 'd8' course, the stitches, which suspended on the knitting needles of the positions left side to the position 'q' in the rear needle bed 'B', are shifted right ward for two pitches, so that double stitches are formed on the knitting needle of the position 'r' and the left end of the row of stitches is linked to the outward side. The shift of the stitches is done in a manner that once the stitches are transferred from the rear needle bed 'B' to the front needle bed 'F', then the rear needle bed 'B' is shifted left ward for two pitches to the front needle bed 'F', and the stitches transferred to the front needle bed 'F' are got back to the rear needle bed 'B' by transferring again. The hanging stitch suspended on the knitting needle of the position 'a' in the front needle bed 'F' is overlapped on the stitch suspended the knitting needle of the position 'd' in the rear needle bed 'B' so that the right end of the row of stitches is linked to the outward side. The rear needle bed 'B' is got back right ward for two pitches to the front needle bed 'F'. Such shift for stitches are done by a plurality of carriage running courses without yarn feeding.

In 'd9' course, with right ward yarn feeding to the rear needle bed 'B', the right side row of stitches for the homeward side of the heel 32 is formed as well as the row of stitches for four stitches, which becomes one course for the part 42*c* of the gusset 42, is formed on the right side knitting needles of the positions 't', 'v', 'x', 'z'. In 'd10' course, with left ward yarn feeding to the front needle bed 'F', the row of stitches for the homeward side of the heel 32 as well as the row of stitches for four stitches, which becomes one course for the part 42*c* of the gusset 42, is formed on the left side knitting needles of the positions 'i', 'g', 'e', 'c'. In 'd11' course, as similar in 'd8' course, by shifting the row of stitches for the homeward side of the heel 32, linking on the knitting needles of the positions 't', 'f' is done. As follows in a similar way, knitting the homeward side of the heel 32 and knitting the parts 42*c*, 42*d* are done, with getting back row of stitches by transferring and with linking at end potion, so that the heel 32, in which the gusset 42 intervenes in the linking part, is able to be knitted.

Figure 12:
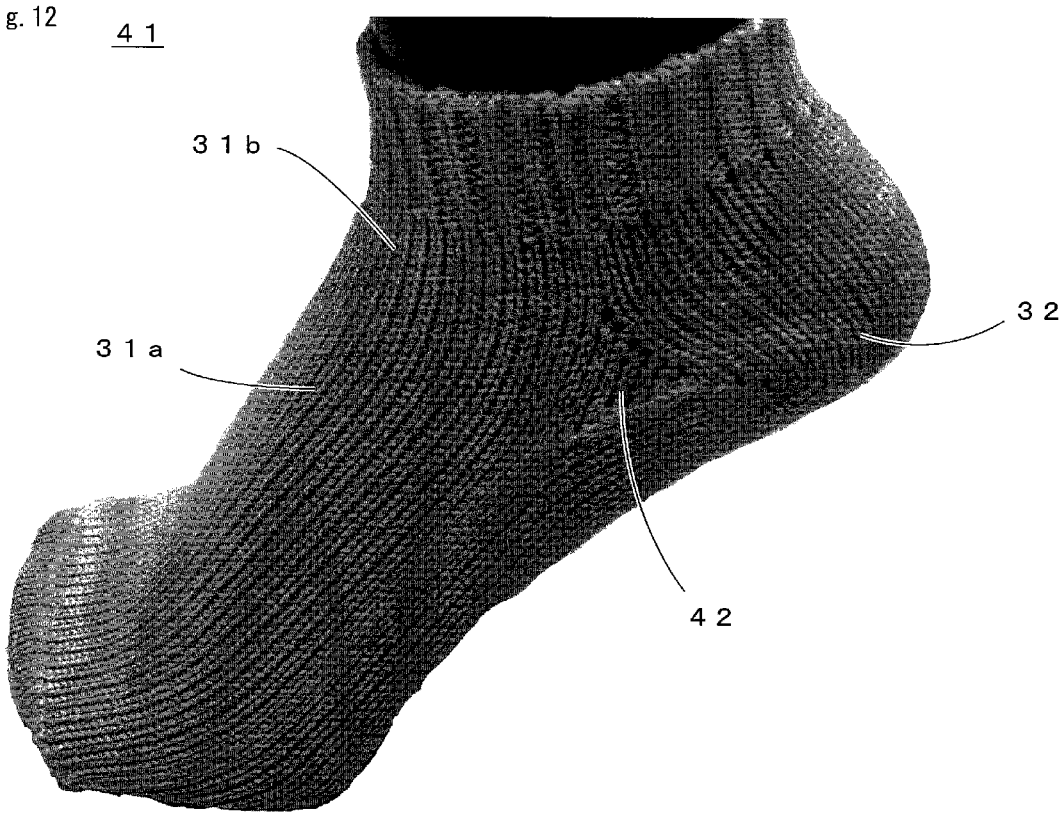
FIG. 12 is a perspective view showing a whole structure of the sock 41 of FIG. 9(*a*).

FIG. 12 shows an entire structure of the sock 41 of FIG. 9(*a*). The toe side 32*a*, which knitted as round knitted tubular fabric, is formed to be a base fabric, to which the heel 32 knitted as tubular fabric is formed so as to be appended, and the gusset 42 is made to intervene in the linking portion, then the ankle side 31*b* is knitted as rest of the base fabric. The sock 41 can be obtained so as to adapt to fit the three dimensional shape of the foot.

In addition, the heel 32 or the like is able to be knitted not only in a symmetrical shape in relation to the center line of the knitting width, but also left-right asymmetry. In the knitted heel 32, the angle or the depth of the gore line is changed from the left-right symmetry state, so that it can be more adapted to the left-right asymmetry shape of the foot.

Embodiment 5

Figure 13:
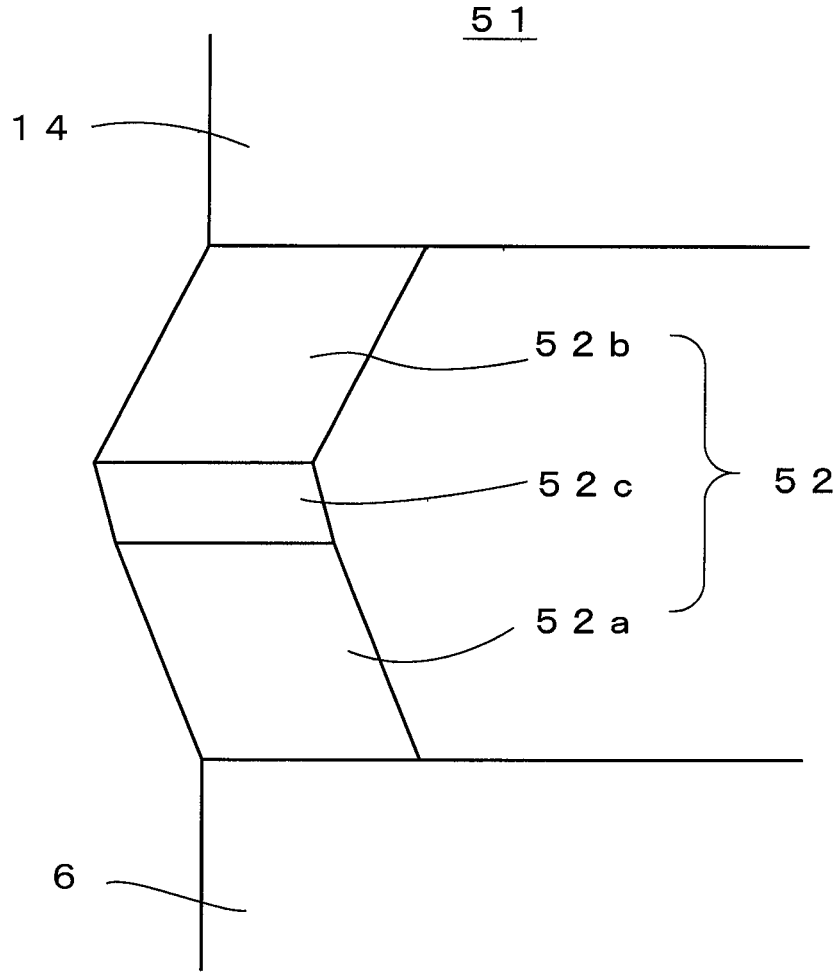
FIG. 13 is an illustration showing a partial knitting state of a glove 51 as the 5th embodiment of the present invention.

FIG. 13 shows a simplified knitting state of a glove 51 as the 5th embodiment of the present invention. In the 5th embodiment, as an alternative to the thumb pouch 11, which is appended to the glove 1 of the 1st embodiment in the way to knit the five finger body 14 from the four finger body 14, a thumb pouch 52 is appended to the glove 51. In the glove 51, an outward side 52*a* and a homeward side 52*b* as well as a stitch increase part 52*c* are knitted. The stitch increase part 52*c* is, for example, appended to the outward side 52*a*, so that it is possible to provide a difference in number of stitches between before and after folding back to form the tubular knitted fabric.

Figure 14:
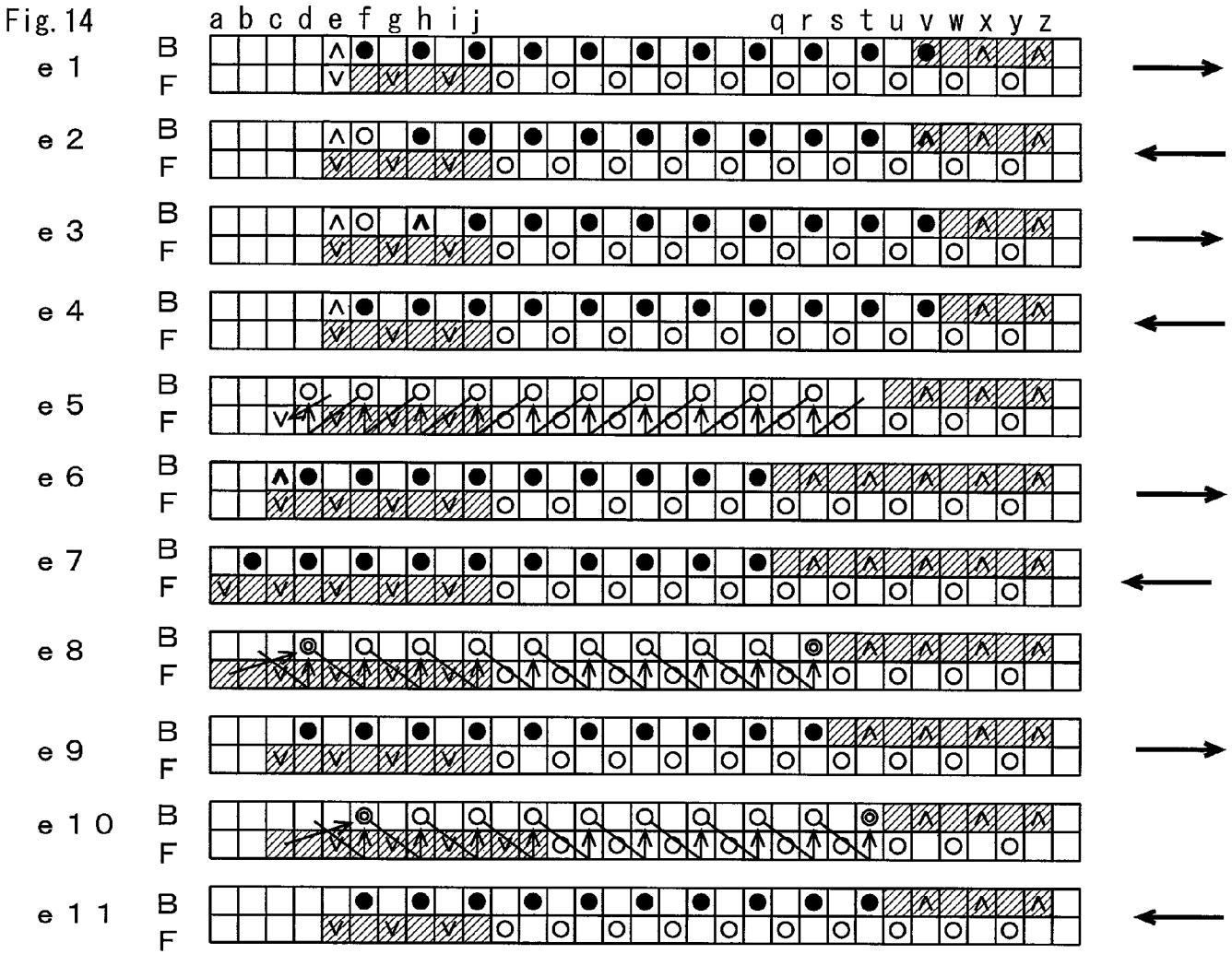
FIG. 14 is a knitting diagram showing a part of a knitting procedure of FIG. 13.

FIG. 14 shows a part of the knitting procedure of FIG. 13 basically as similar to FIG. 11. Although FIG. 13 shows a state in which the stitch increase part 52*c* is appended to the back of the outward side 52*a* as a whole, in this knitting procedure, the stitch increase part 52*c* is knitted in the shape of dispersing state insert to intermediate portion. To 'e1' course, knitting the outward side 52*a* of the thumb pouch 52 is done, with shifting the row of stitches, while hanging stitches for linking being remained at end portions. From 'e1' course to 'e4' course, with flechage yarn feeding to the rear needle bed 'B', the row of stitches for the stitch increase part 52*c* is formed on the knitting needles between the position 'f' and the position 'v'. However, the row of stitches for the stitch increase part does not link to the end portion of the homeward side 52*b*, so that, on the knitting needles of the positions 'f', 'h' for the left end portion or of the position 'v' to the right side end portion, stitches are not every time formed, but the tuck or the like is done, so as to prevent from leaving a hole between before and after the fold back as a tubular knitted fabric.

From 'e5' course to 'e6' course, a part of knitting procedure is shown, in the procedure the outward side 52*a* is knitted with remaining on the end portion hanging stitches for linking. From 'e8' course to 'e11' course, a part of knitting procedure is shown, in the procedure, with getting back shift, the row of stitches is knitted while the end portion is linked to the outward side 52*a*.

Figure 15:
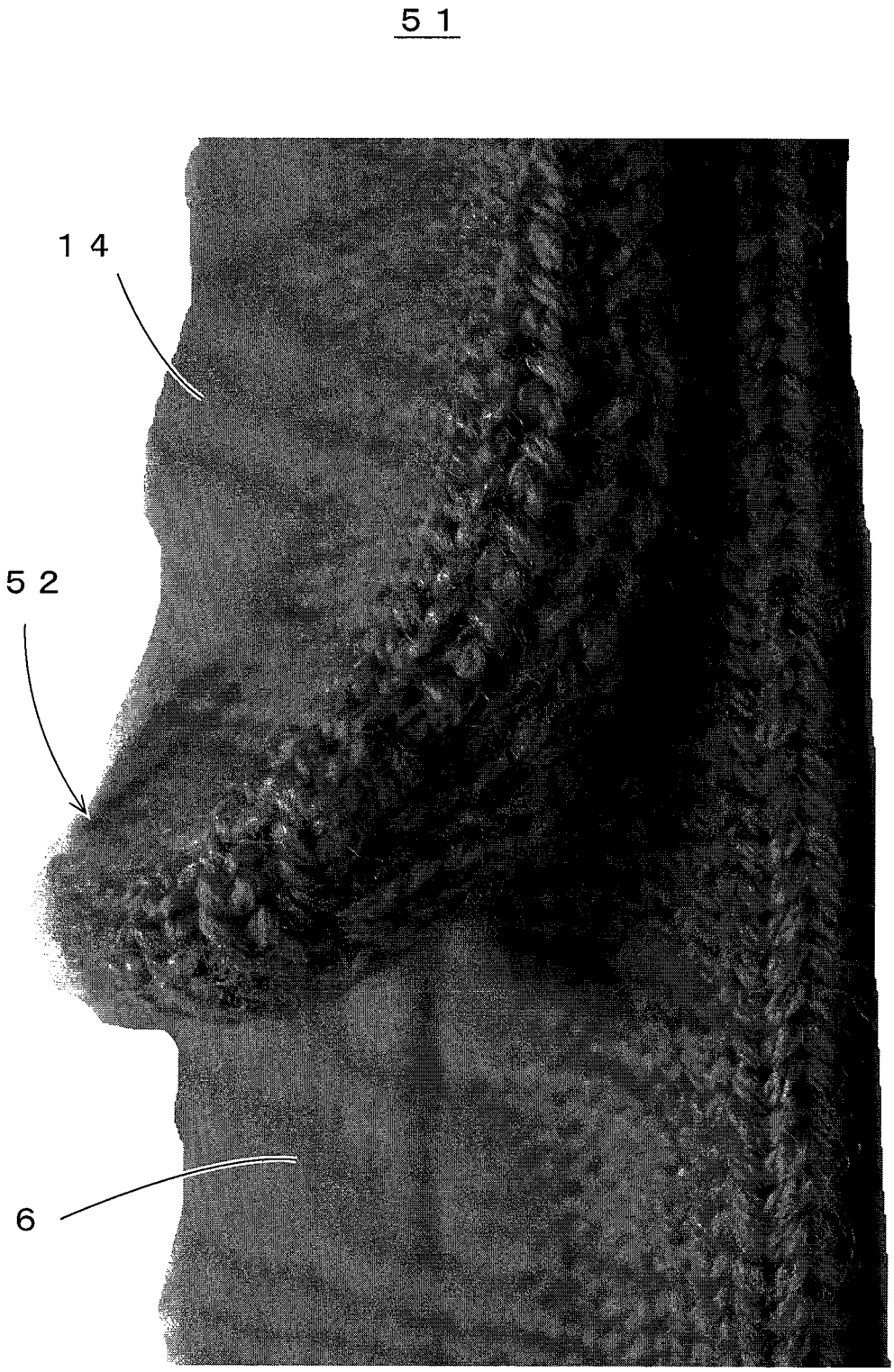
FIG. 15 is a side view showing a part of the glove 51 of FIG. 13.

FIG. 15 shows a part of the glove 51 of FIG. 13. The thumb pouch 52 is knitted, in a manner in which the number of stitches in the wale direction for the outward side to be continued to the four finger body 6 is more than that for the homeward side to be continued to the five finger body 14, so that it can be fitted to the three dimensional shape of the thumb.

Embodiment 6

Figure 16:
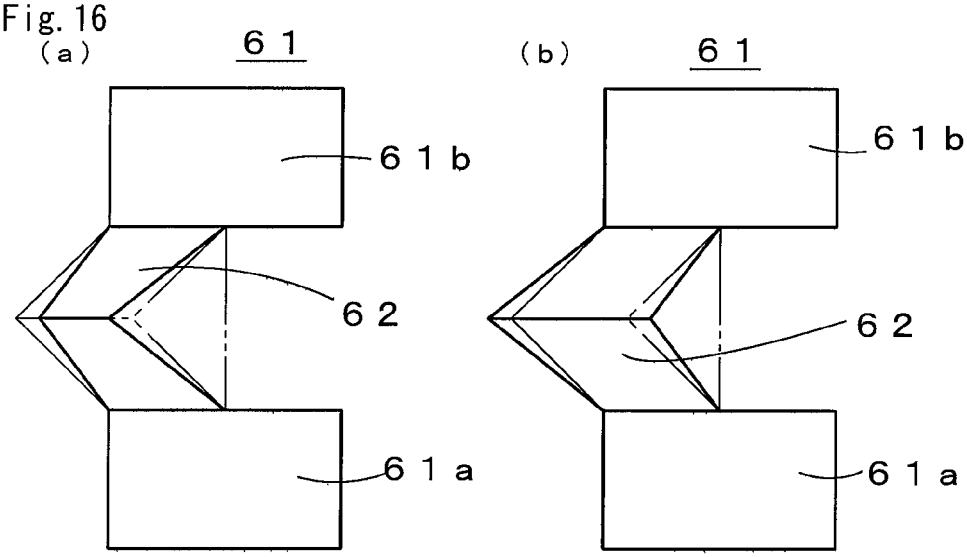
FIG. 16 is an illustration showing a partial knitting state of a glove 61 as the 6th embodiment of the present invention.

FIG. 16 shows a part of simplified knitting state for a glove 61 as the 6th embodiment of the present invention. When a thumb pouch 62 is knitted as a tubular knitted fabric with shifting row of stitches from a base fabric 61*a*, 61*b* like a body part and so on of the glove 61, various kinds of shaping knit to be known for the flatbed knitting machine are able to be applied. That is, as shown in (a) the knitting width can be decreased in the outward side and increased in the homeward side, or as shown in (b) the knitting width can be increased in the outward side and decreased in the homeward side. Further the knitting width can be increased or decreased along the way. In case the process of increase or decrease for the knitting width is done inside apart from end portion of the knitting width, stitches of the end portion of the knitting width, are made to be continuous in the wale direction, The shaping knit by increase and decrease of the knitting width as shown in (b), is not always applied to a finger pouch, but is able to applied to the pocket 23 of the knitted fabric with pocket 21 of the 2nd embodiment, or to some occasions like to cover bulge regions of the human body.

Figure 17:
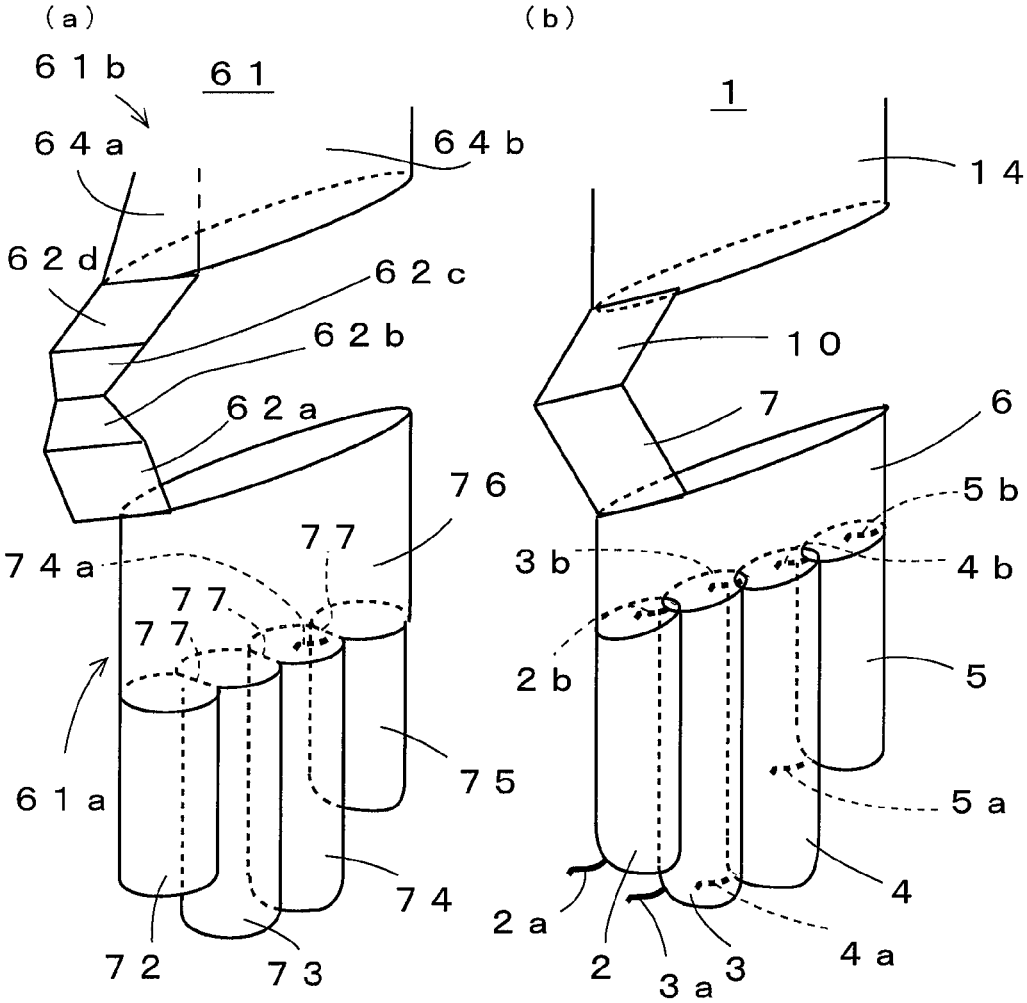
FIG. 17 is an illustration showing a knitting procedure of the glove 61 in comparison with the glove 1 as the 1st embodiment.

FIG. 17 shows a knitting procedure of the glove 61 of FIG. 16 in comparison to the glove 1 as the 1st embodiment. In the glove 61 as shown in (a), from the base fabric 61*a*, which becomes a four finger body, the outward sides 62*a*, 62*b* for the thumb pouch 62 are knitted and, after folded back, the homeward sides 62*c*, 62*d* are knitted. Although the outward side 62*a* and the homeward side 62*d* are knitted in a state in which the knitting width is constant, the outward side 62*b* and the homeward side 62*c* are knitted with the shaping knit, in which the narrowing and the widening are respectively done. In the outward side of thumb pouch 7 and the homeward side of thumb pouch 10, which are shown in (b), the shaping knit is not done.

Further, the glove 61 shown in (a), finger pouches 72, 73, 74, 75, to accommodate fingers other than the thumb, is knitted as a tubular knitted fabric with shifting the row of stitches, for example, from a ground of finger pouch 74 for the fourth finger in series, a three finger body is knitted as a round knitted tubular fabric, then a finger pouch 75 for the fifth finger is knitted so as to continue to a round knitted tubular fabric for a four finger body 76. At the first knitting time of the finger pouch 74, yarn in for knitting yarn is performed so that an edge yarn 74*a* is generated, but other finger pouch or body is knitted while setting up to follow end portion of already knitted fabric, without generating other edge yarn a base fabric 61*a* can be knitted.

In the glove 1 as shown in (b), when each finger pouch 2, 3, 4, 5 is knitted as a round knitted tubular fabric respectively, yarn in at front edge and yarn out at rear anchor are done, so that edge yarns 2*a*, 2*b*; 3*a*, 3*b*; 4*a*, 4*b*; 5*a*, 5*b* are generated, so that some appropriate process for those is necessary.

Further the glove 1 lacks space around the finger crotches of the linking portion between the finger pouches 2, 3, 4, 5 each other or the four finger body 6, which are knitted as round knitted tubular fabrics. The glove 61 shown in (a), the stitches are continuous in the wale direction at the finger crotches, so that a thickness 77 is formed between adjacent each finger so as to have space and improve sense of wear. Further in the base fabric 61*b* which becomes the five finger body, the stitches of the part 64*a* are continuous to the homeward side 62*d* of the thumb pouch 62 so that the part 64*a* is shaped with narrowing in series so as to fit to a palm portion 64*b*, so that it is possible to adapt to the three dimensional shape of the hand.

Figure 18:
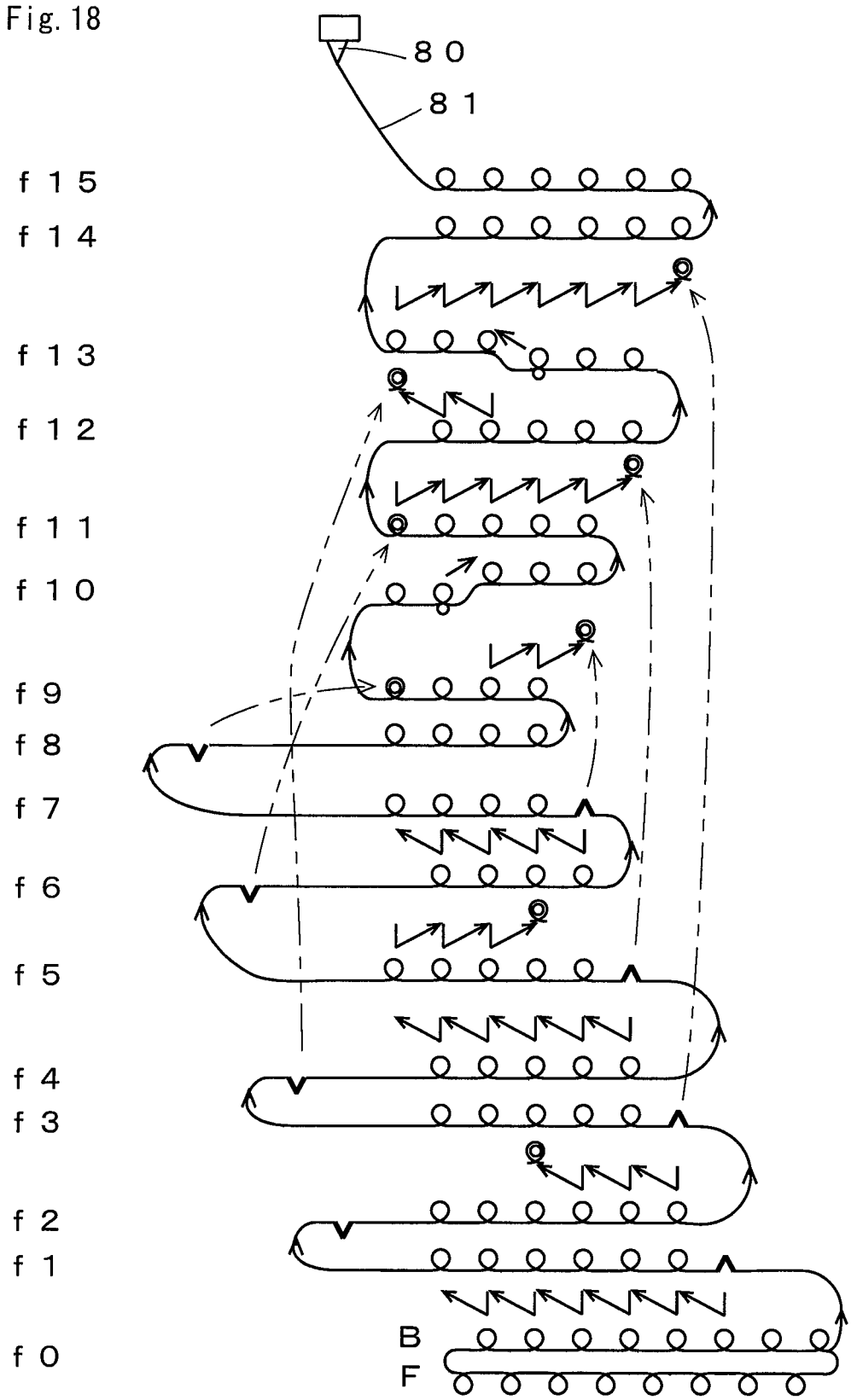
FIG. 18 is a process diagram showing a knitting state of a thumb pouch 62 of the glove 61 of FIG. 16.

FIG. 18 shows, as a process diagram, a knitting state with shaping knit for the finger pouch of the glove 61 of FIG. 17. Number of stitches and number of courses are for convenience of explanation, in the actual knitting fabric, they are able to be changed according to need. In 'f0' course, a round knitted tubular fabric as a base fabric, for eight stitches, are made suspended in a state of half gauge on the front needle bed 'F' and the rear needle bed 'B' respectively. In each needle bed, a knitting needle opposing to a knitting needle suspending a stitch is made to be an empty needle. As follows, the one pitch for shifting stitch and so on is explained as of two needles.

In 'f1' course, after the six stitches of the left side in the eight stitches suspended on the rear needle bed 'B' is shifted left ward for one pitch, with left ward yarn feeding, a hanging stitch is formed on the knitting needle which is made to an empty needle by shifting, then on the six knitting needles left side of the hanging stitch, new six stitches are formed. In 'f2' course, with right ward yarn feeding, a hanging stitch is formed on an empty needle in the left side of the front needle bed 'F', then on the six stitches of the rear needle bed 'B', new stitches are formed.

In 'f3' course, the three stitches of the right side in the newly formed six stitches in 'f2' course, are shifted left ward for one pitch so that the left end stitch is overlapped on the right end stitch in the three stitches remained without shifting, to reduce one stitch. Further with left ward yarn feeding, a hanging stitch is formed on the empty needle generated the left ward shifting for the right side three stitches, and on the five stitches left side of the hanging stitch, new stitches are formed. In 'f4' course, with right ward yarn feeding, a hanging stitch is formed on an empty needle in the left side of the front needle bed 'F', and then new stitches are formed on the five stitches in the rear needle bed 'B'.

In 'f5' course, the newly formed five stitches in 'f4' course, after shifted, as a whole, left ward for one pitch, with left ward yarn feeding, a hanging stitch is formed on the knitting needle made to be an empty needle, and then new stitches are formed on the five stitches left side of the hanging stitch.

In 'f6' course, the three stitches of the left side in the newly formed five stitches in 'f5' course, are shifted right ward for one pitch so that the right end stitch is overlapped on the left end stitch in the two stitches remained without shifting, to reduce one stitch. Further with right ward yarn feeding, a hanging stitch is formed on an empty needle in the left side of the front needle bed 'F', and then new stitches are formed on the four stitches in the rear needle bed 'B'.

In 'f7' course, the newly formed four stitches in 'f6' course, after shifted, as a whole, left ward for one pitch, with left ward yarn feeding, a hanging stitch is formed on the knitting needle made to be an empty needle, and then new stitches are formed on the four stitches left side of the hanging stitch. In 'f8' course, with right ward yarn feeding, a hanging stitch is formed on an empty needle in the left side of the front needle bed 'F', and then new stitches are formed on the four stitches in the rear needle bed 'B'. In 'f8' course, knitting for the outward side is finished.

From 'f9' course, the homeward side after fold back is knitted. The hanging stitch, which is formed in left side of the front needle bed 'F' in 'f8' course, is overlapped on and linked to the left end of the four stitches in the rear needle bed 'B' by stitch transferring, and then with left ward yarn feeding, new stitches are formed on the four stitches in the rear needle bed 'B'.

In 'f10' course, the two stitches of the right side in the four stitches in the rear needle bed 'B', are shifted right ward for one pitch, with right ward yarn feeding, new stitches are formed on the left side two stitches and on the right side two stitches. Knitting needles between the left side two stitches and the right side two stitches are made to be empty. To the right end of the left side two stitches, the split knit is operated and the split stitch is shifted to the adjacent empty needle. Thus, one stitch is increased in the left side.

In 'f11' course, the hanging stitch, which is formed in left side of the front needle bed 'F' in 'f6' course, is overlapped on the left end of the five stitches in the rear needle bed 'B' by stitch transferring, and then with left ward yarn feeding, new stitches are formed on the five stitches in the rear needle bed 'B'. In 'f12' course, the five stitches are shifted, as a whole, right ward for one pitch. The right end of the five stitches, is overlapped on and linked to the hanging stitch, which is formed in 'f5' course. Next, with right ward yarn feeding, new stitches are formed on the five stitches.

In 'f13' course, the two stitches of left side in the five stitches in the rear needle bed 'B', are shifted left ward for one pitch, on the left end stitch, the hanging stitch formed in 'f4' course is overlapped and then linked. Next, with left ward yarn feeding, new stitches are formed on the left side two stitches and the right side three stitches. Knitting needles between the left side two stitches and the right side three stitches are made to be empty. To the left end of the right side three stitches, the split knit is operated and the split stitch is shifted to the adjacent empty needle. Thus, one stitch is increased in the right side. In 'f14' course, the six stitches are shifted, as a whole, right ward for one pitch. The right end of the six stitches, is overlapped on and linked to the hanging stitch, which is formed in 'f3' course. Next, with right ward yarn feeding, new stitches are formed on the six stitches. After 'f15' course, with a knitting yarn 81 fed from a yarn feeder 80, knitting of the tubular fabric is continued. In addition, in the present embodiment, as shaping knit, the narrowing is done in 'f3' course and 'f6' course, and the widening is done in 'f10' course and 'f13' course, respectively.

Figure 19:
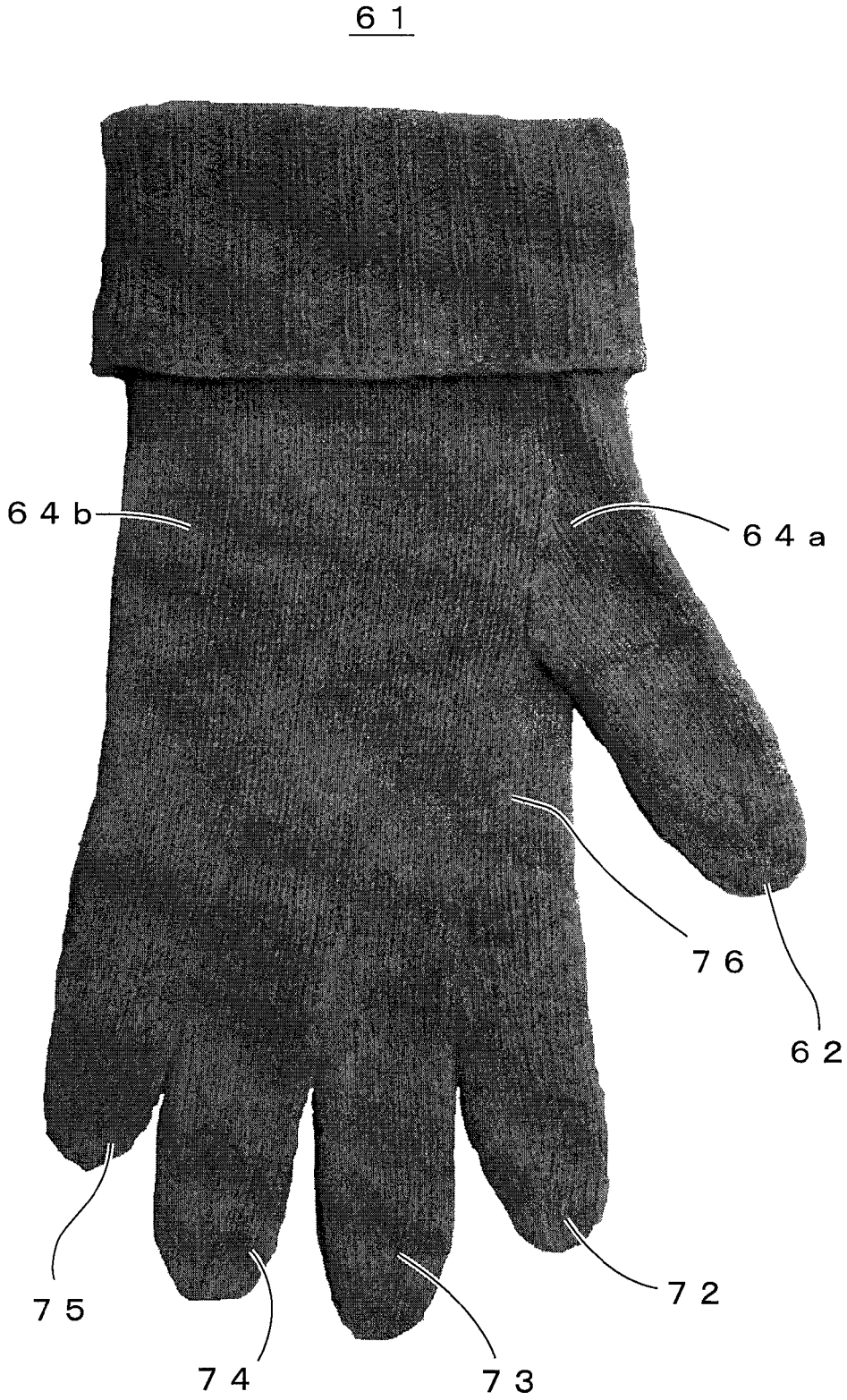
FIG. 19 is a plan view showing a whole structure of the glove 61 of FIG. 16.

FIG. 19 shows an entire structure of the glove 61 of FIG. 16. By knitting the thumb pouch 62 and other finger pouches 72, 73, 74, 75 as tubular fabrics with shifting row of stitches and including the shaping knit, the glove 61 is adapted to the three dimensional shape of the hand. Further the increase and decrease of the knitting width by the shaping knit is done inside apart from the end portion of the knitting width so that the thumb pouch 62 and other finger pouches 72, 73, 74, 75 can be formed in a manner that the stitches are continued to and lined up in the wale direction respectively on the area adjacent to the linking part between the fabric of the outward side and the fabric of the homeward side. Further, the narrowing or the widening to the stitches for changing the knitting width can be done in the vicinity of the end portion of the finger pouch.

INDUSTRIAL APPLICABILITY

The present invention is applicable to various fabrics other than the gloves 1, 51, 61 explained in the 1st embodiment, in the 5th embodiment, in the 6th embodiment, the knitted fabric with pocket 21 explained in the 2nd embodiment, and the socks 31, 41 explained in the 3rd embodiment, 4th embodiment. For example, supposing a hat in which the base fabric 22 of FIG. 7 covers a head region and two parts are appended in a manner that each part corresponds to the pocket 23 and covers an ear. Further, a tubular knitted fabric like the pocket 23 can be formed not only to intermediate portion of the base fabric 22 in the wale direction, but also to the starting end or to the terminating end.

The present invention is applicable to the tubular knitted fabric with shifting row of stitches, in which the tubular width and the tubular height are optional, connecting position and number can be freely set. Further, in each embodiment, although the half gauge knitting is done with using a two bed type flatbed knitting machine having one pair of needle beds, the all needle knitting can be done by using a four bed type flatbed knitting machine, or in case of two bed type flatbed knitting machine which has the compound needle capable of holding by slider, as a knitting needle.

REFERENCE SIGNS LIST

1, 51, 61 Glove
7 Outward side of thumb pouch
8, 9. Hanging stitch
10. Homeward side of thumb pouch
11, 52, 62. Thumb pouch
12, 24. Outside boundary part
13, 25. Inside boundary part
21 Knitted fabric with pocket
22, 71*a*, 71*b* Base fabric
23 Pocket
31, 41 Sock
31*a* Toe side
31*b* Ankle side
32 Heel
32*a* Constant knitting width portion
32*b* Decrease knitting width portion
42 Gusset
72, 73, 74, 75 Finger pouch

The invention claimed is:

1. A tubular knitted fabric knitted without sewing by a flatbed knitting machine, comprising:

a fold back portion knitted by a flechage knitting, in which reciprocating knits with respect to a course direction are repeated, and provided midway in the fabric knitted continuously in a wale direction, at the fold back portion the fabric being folded back and divided into two side fabrics with respect to the wale direction, so that the one side fabric is opposed to the other side fabric, and a linking part formed with double stitches made by stitch transferring between an end portion in the course direction of the one side fabric and an opposed end portion in the course direction of the other side fabric.

2. The tubular knitted fabric according to claim 1, further comprising a part, which is formed over two regions, each said region belonging to said one side fabric or said other end side fabric, and being adjacent to said linking part between said side fabrics, so as to continue more than three courses of stitches lining up in the wale direction, and forms a tube of uniform diameter.

3. The tubular knitted fabric according to claim 1, wherein a part of said end portion of at least one of said one side fabric or said other side fabric in the wale direction continues to another fabric, and in a boundary part between said one side fabric in the wale direction and said part of the end portion, stitches are continuous with respect to the wale direction.

4. The tubular knitted fabric according to claim 1, further comprising a part of fabric, which becomes a gusset, in said linking part formed between said one side fabric and said other side fabric, with respect to the wale direction.

5. The tubular knitted fabric according to claim 1, wherein said one side fabric and said other side fabric with respect to the wale direction, differ in shape by at least the number of courses or number of stitches for corresponding courses.

6. The tubular knitted fabric according to claim 1, further comprising a finger pouch for accommodating a finger of a glove or a sock, formed by linking between said one side fabric and said other side fabric with respect to the wale direction.

7. The tubular knitted fabric according to claim 1, further comprising a heel portion of a sock for accommodating a heel of a foot, being formed by linking between said one side fabric and said other side fabric with respect to the wale direction.

8. A knitting method using a flatbed knitting machine provided with a stitch transfer function, comprising knitting a flechage knitted fabric wherein the flechage knitted fabric is knitted as a row of stitches formed by repeating reciprocating knits in a course direction, and being folded back halfway of continuous knitting in a wale direction so that the folded back portion forms an outward side fabric and an opposed homeward side fabric, knitting, in the outward side fabric, stitches for linking, so as to hang on different knitting needles than knitting needles which hang stitches for linking added to end portions of the already knitted row of stitches and at least one accompanying shift for row of stitches by repeating to add to end portions and to hang on knitting needles, knitting, in the homeward side fabric, at least one row of stitches, which is predetermined to correspond to the row of stitches of the outward side fabric to be added with the stitches for linking at end portions, wherein the end portions are linked to the stitches for linking with overlapping by stitch transfer, wherein the knitting is repeated and wherein the accompanying shifts to the outward side fabric being got back, and linking the outward side fabric with the homeward side fabric at said end portions of knitting width opposing to each other.

9. The knitting method according to claim 8, wherein said outward side fabric, on the way to knit a different fabric which becomes a base fabric, begins to knit in a state where the base fabric pauses to be knitted, and said accompanying shift for row of stitches in said outward side fabric being done, in a direction apart from the knitted width of the base fabric.

10. The knitting method according to claim 9, wherein before said outward side fabric is knitted and linked with the homeward side fabric, a fabric for increasing thickness is added to the outward side fabric.

11. The knitting method according to claim 9, wherein at least one of said outward side fabric and said homeward side fabric are knitted with a shaping knit, in which widening or narrowing is done to the knitted row of stitches.

* * * * *